US011766102B2

(12) United States Patent
Garrison et al.

(10) Patent No.: US 11,766,102 B2
(45) Date of Patent: Sep. 26, 2023

(54) WIND-RESISTANT BEACH UMBRELLA

(71) Applicant: Yotrio Group Co., Ltd, Linhai (CN)

(72) Inventors: Scott A. Garrison, Fitchbury, WI (US); Luke S. Harding, Mooresville, NC (US)

(73) Assignee: Yotrio Group Co., Ltd., Zhejiang (CN)

( * ) Notice: Subject to any disclaimer, the term of this patent is extended or adjusted under 35 U.S.C. 154(b) by 115 days.

(21) Appl. No.: 17/528,191

(22) Filed: Nov. 17, 2021

(65) Prior Publication Data

US 2022/0071359 A1 Mar. 10, 2022

Related U.S. Application Data

(63) Continuation-in-part of application No. 16/945,172, filed on Jul. 31, 2020, now abandoned.

(51) Int. Cl.

| | |
|---|---|
| ***A45B 25/22*** | (2006.01) |
| ***A45B 19/00*** | (2006.01) |
| ***A45B 23/00*** | (2006.01) |
| ***A45B 25/18*** | (2006.01) |
| ***E04H 12/22*** | (2006.01) |

(52) U.S. Cl.

CPC ..... *A45B 25/22* (2013.01); *A45B 19/00* (2013.01); *A45B 23/00* (2013.01); *A45B 25/18* (2013.01); *E04H 12/2223* (2013.01); *A45B 2019/001* (2013.01); *A45B 2023/0012* (2013.01); *A45B 2025/186* (2013.01); *A45B 2200/1036* (2013.01)

(58) Field of Classification Search

CPC .. A45B 25/18; A45B 25/22; A45B 2023/0012

See application file for complete search history.

(56) References Cited

U.S. PATENT DOCUMENTS

| | | | | |
|---|---|---|---|---|
| 1,031,974 A * | 7/1912 | Thomas | ..... | A45B 25/22 135/33.7 |
| 3,032,047 A * | 5/1962 | Wendorf | ..... | A45B 25/22 135/33.7 |
| 3,456,661 A * | 7/1969 | Farley | ..... | A45B 25/22 135/33.7 |

(Continued)

FOREIGN PATENT DOCUMENTS

KR 20110089708 A * 8/2011

*Primary Examiner* — Noah Chandler Hawk

(74) *Attorney, Agent, or Firm* — Jingming (James) Cai; SAC Attorneys LLP

(57) ABSTRACT

A wind-resistant umbrella including a canopy attached to an upper end of a pole member, flexible ribs, and multiple load sensitive connectors (LSCs) is provided. The flexible ribs flex inwardly at a wind speed of more than about 10 miles per hour (mph) to preclude wind from traveling under the canopy. The LSCs detachably couple an upper canopy section to a lower canopy section of the canopy. The upper canopy section partially overlaps the lower canopy section along the LSCs. Upon impact from a wind gust that exceeds a speed of more than about 20 mph, at least one of the LSCs detach to allow wind to flow freely through one or more vents created between the upper and lower canopy sections, while providing warnings to a user, and to preclude wind-induced tilting and lifting actions on the wind-resistant umbrella, thereby precluding dislodgment thereof from an anchoring location.

23 Claims, 25 Drawing Sheets

(56) References Cited

U.S. PATENT DOCUMENTS

| | | | | | |
|---|---|---|---|---|---|
| 5,065,779 | A * | 11/1991 | Johnson | A45B 25/22 | 135/33.7 |
| 5,368,055 | A * | 11/1994 | Johnson | A45B 25/22 | 135/33.7 |
| 6,401,737 | B1 * | 6/2002 | Kloor, III | A45B 25/22 | 135/33.7 |
| 6,487,977 | B1 * | 12/2002 | Williams | E04H 12/2223 | 108/150 |
| 6,612,320 | B2 * | 9/2003 | Lin | A45B 25/22 | 135/33.7 |
| 8,191,561 | B2 * | 6/2012 | Brooks, III | E04H 12/2223 | 248/533 |
| 2011/0030751 | A1 * | 2/2011 | Wu | A45B 25/22 | 135/98 |
| 2019/0053588 | A1 * | 2/2019 | Price | A45B 23/00 | |

* cited by examiner

WIND-RESISTANT BEACH UMBRELLA

CROSS-REFERENCE TO RELATED APPLICATIONS

This application is a continuation-in-part (CIP) patent application of the non-provisional patent application titled "Wind-resistant Beach Umbrella", application Ser. No. 16/945,172, filed in the United States Patent and Trademark Office on Jul. 31, 2020. The specification of the above referenced patent application is incorporated herein by reference in its entirety.

BACKGROUND

Every year there are injuries and even deaths associated with beach umbrella accidents, most of which are caused by beach umbrellas dislodging from sand, soil, or the ground due to high-speed winds, and blowing across a beach, carried by the high-speed winds. Damage, injuries, and fatalities associated with malfunctions of beach umbrellas, and from the beach umbrellas becoming air-borne due to high gusts of wind are a common occurrence. High-speed winds blow beach umbrellas across the beach, damage fixtures on the beach, and injure people on the beach, with substantial damage occurring when wind speeds exceed about 20 miles per hour (mph). The resistance to wind typically depends on the shape and size of a canopy of a beach umbrella and an interface of the beach umbrella with sand on the beach. The resistance of conventional beach umbrellas to being dislodged from their positions on the beach by wind depends in part on the shape and size of the canopy of the beach umbrella, the type of tip on a lower pole of the beach umbrella, and the depth of insertion of the beach umbrella into the sand. On the beach, the most frequent cause of a beach umbrella dislodging from its position in the sand is improper insertion or wind forces tilting the beach umbrella to a degree that allows wind gusts to create a lift on an underside of the canopy of the beach umbrella. For example, beyond about 10 mph, wind tilts the beach umbrella beyond 15 degrees from a vertical position. After about 15 degrees of tilt, the wind flows under the canopy of the beach umbrella, creating lift on an underside of the canopy. The process of tilting and lifting of the beach umbrella results in wind forces pulling or dislodging the beach umbrella from the sand, the soil, or the ground and causing the beach umbrella to fly away.

Canopies of beach umbrellas are typically hexagon- or octagon-shaped fabric structures commonly spanning, for example, about five feet to about eight feet in diameter. The shape of the canopy is designed to provide shade and protection from ultraviolet (UV) radiation over a large area to users below the canopy. However, a drawback to the shape of the canopy is that the canopy is highly susceptible to wind gusts that create a lift on the underside of the canopy of the beach umbrella. A wind force, typically created when wind speeds exceed about 20 mph, can suddenly dislodge a beach umbrella from the sand without warning, resulting in a spear-like object hurtling across the beach and damaging fixtures and injuring people on the beach.

Attempts have been made to reduce the effects of wind gusts on beach umbrellas. For example, a beach umbrella is equipped with a system having a venting action performed by a small canopy fixed on top of a larger, main canopy, where a space between the two canopies is open to allow wind to flow through the beach umbrella. This system works with low-speed winds below about 15 mph. When wind gusts exceed about 15 mph, this system begins to fail as this system relies heavily on a user's knowledge and skill in properly inserting the beach umbrella into the sand to a recommended depth. Even when a beach umbrella with a screw-in style auger is buried to the recommended depth in the sand, a strong wind gust with a speed in excess of about 20 mph, can dislodge the beach umbrella from the sand with little or no warning because the force of the wind gust exceeds the anchoring power of the screw-in style auger. Wind tunnel testing of conventional umbrellas shows that conventional umbrellas cannot resist repeated or sustained wind gusts in excess of about 20 mph, without dislodging or becoming otherwise unusable.

Hence, there is a long-felt need for a wind-resistant umbrella for dissipating wind gusts in excess of about 20 mph, to eliminate tilting and lifting actions caused by the wind on the umbrella to preclude the umbrella from being dislodged from its position and being blown down the beach, thereby ensuring a safe beach environment. Furthermore, there is a need for a wind-resistant umbrella that provides warnings, for example, audio and/or visual warnings, to a user that the speed of the wind is beyond a predefined safe limit.

SUMMARY

This summary is provided to introduce a selection of concepts in a simplified form that are further disclosed in the detailed description. This summary is not intended to determine the scope of the claimed subject matter.

The apparatus disclosed herein addresses the above-recited need for a wind-resistant umbrella, configured for use as a beach umbrella, for dissipating wind gusts in excess of about 20 miles per hour (mph), to eliminate tilting and lifting actions caused by wind on the umbrella to preclude the umbrella from being dislodged from its position and being blown down the beach, thereby ensuring a safe beach environment. The wind-resistant umbrella disclosed herein provides warnings, for example, audio and/or visual warnings, to a user of the umbrella that the speed of the wind is beyond a predefined safe limit. The wind-resistant umbrella disclosed herein provides a depth indicator to install the umbrella to a recommended depth into an anchoring location, for example, sand on a beach, soil, or the ground, and therefore does not rely on knowledge or skills of the user for appropriately inserting the umbrella into the anchoring location to the recommended depth as is encouraged. The wind-resistant umbrella precludes wind forces from tilting the umbrella to a predefined degree, thereby precluding creation of lift on an underside of a canopy of the umbrella. The wind-resistant umbrella, therefore, resists a pull from the anchoring location and remains in the anchoring location by preventing wind forces from causing the wind-resistant umbrella to tilt and lift.

The wind-resistant umbrella disclosed herein comprises a pole member, a canopy, multiple flexible ribs, multiple load sensitive connectors, and multiple vents. In an embodiment, the pole member comprises an upper pole section and a lower pole section. The upper pole section is coaxially connected to the lower pole section using a securing assembly. The securing assembly is configured to couple and lock the upper pole section to the lower pole section of the pole member. In an embodiment, the wind-resistant umbrella further comprises an anchoring element, for example, a screw-in style auger, fixed at an anchoring portion of the lower pole section of the pole member. The anchoring element is configured to securely lodge the pole member into the anchoring location, for example, into sand at a beach, or into soil, or into the ground of a field at a sporting event. In an embodiment, the wind-resistant umbrella further comprises a depth indicator, for example, a line, configured or marked at a predefined distance from a tip of the lower pole section of the pole member. The depth indicator is configured to indicate a predetermined depth to insert the pole member into the anchoring location for maximum safety to preclude the dislodgment of the pole member from the anchoring location.

The canopy of the wind-resistant umbrella is attached to an upper end of the pole member. The canopy comprises an upper canopy section and a lower canopy section. The upper canopy section is detachably coupled to the lower canopy section. A surface area of the detachably coupled upper canopy section is of a predefined size with respect to a surface area of the lower canopy section. The predefined size of the surface area of the detachably coupled upper canopy section is, for example, between about 45% and about 60% of the surface area of the lower canopy section. This ratio is dependent on the overall diameter of the canopy and is configured to maximize wind flow. The lower canopy section of the canopy is positioned coaxial to a position of the upper canopy section of the canopy about the pole member. The flexible ribs of the wind-resistant umbrella extend radially from the upper end of the pole member towards a lower peripheral edge of the lower canopy section of the canopy. The flexible ribs are configured to support the upper canopy section and the lower canopy section of the canopy and flex inwardly at a predefined wind speed of, for example, more than about 10 mph. The flexible ribs are configured to flex inwardly to preclude the wind from traveling under the canopy.

The load sensitive connectors of the wind-resistant umbrella are positioned on the flexible ribs and attached at a lower peripheral edge of the upper canopy section and proximal to an upper peripheral edge of the lower canopy section. The load sensitive connectors are configured to detachably couple the upper canopy section to the lower canopy section of the canopy. The upper canopy section is configured to partially overlap the lower canopy section along the load sensitive connectors. In an embodiment, each of the load sensitive connectors comprises a bracket assembly and a bolt assembly. The load sensitive connectors, each comprising the bracket assembly and the bolt assembly, constitute an audible connection assembly for detachably coupling the upper canopy section to the lower canopy section of the canopy and for providing an audible warning to the user. The bracket assembly is configured to be attached to the lower canopy section of the canopy. In an embodiment, the bracket assembly comprises a base member, an outer bracket, an inner bracket, and at least two flanges. The outer bracket is rigidly attached to the base member. The outer bracket comprises a space defined by an inner wall of the outer bracket and an upper surface of the base member. The inner bracket is coaxially disposed on the upper surface of the base member, within the space defined by the outer bracket and the upper surface of the base member. The inner bracket comprises an opening defined by an inner wall of the inner bracket. The flanges extend from at least two diametrically opposite sides of the outer bracket. In an embodiment, the bracket assembly further comprises a supplementary flange extending from another side of the outer bracket of the bracket assembly. The flanges are configured to be attached to the lower canopy section of the canopy. The bolt assembly is in engageable communication with the bracket assembly. In an embodiment, the bolt assembly comprises a head member and an elongate member. The head member is configured to be attached to the upper canopy section of the canopy. The elongate member extends from a lower end of the head member. The elongate member is configured to be inserted into the opening of the inner bracket of the bracket assembly for coupling the upper canopy section to the lower canopy section of the canopy. In an embodiment, the bolt assembly further comprises multiple sound generating element configured along a length of the elongate member of the bolt assembly.

The vents of the wind-resistant umbrella are created between the detachably coupled upper canopy section and the lower canopy section of the canopy between the load sensitive connectors. One or more of the load sensitive connectors are configured to detach upon impact from a wind gust that exceeds a predefined wind speed of more than about 20 mph, to allow wind to flow freely through one or more of the vents created between the upper canopy section and the lower canopy section and to preclude tilting and lifting actions caused by the wind on the wind-resistant umbrella, thereby precluding dislodgment of the wind-resistant umbrella from the anchoring location. In the embodiment of the load sensitive connector comprising the bracket assembly and the bolt assembly, when the speed of the wind exceeds the predefined wind speed of more than about 20 mph, the elongate member of at least one of the load sensitive connectors is configured to disengage from the opening in the inner bracket of the bracket assembly of the load sensitive connector(s) and generate a sound to provide an audible warning to the user that the speed of the wind is beyond a predefined safe limit. In an embodiment, the sound generating elements of the bolt assembly, on disengagement of the elongate member of the bolt assembly from the opening in the inner bracket of the bracket assembly, are configured to generate a sound by friction on indentations configured on the inner wall of the inner bracket of the bracket assembly to provide an audible warning to the user that the speed of the wind is beyond a predefined safe limit.

In an embodiment, the wind-resistant umbrella further comprises a highlighted pattern configured on a lower surface of the upper canopy section of the canopy. When the load sensitive connector(s) detaches, the highlighted pattern is revealed for displaying a visual caution to the user that the speed of the wind is beyond a predefined safe limit. In another embodiment, the wind-resistant umbrella further comprises a highlighted flag attached to at least one of the load sensitive connectors, on a lower surface of the upper canopy section of the canopy. When the load sensitive connector(s) detaches, the highlighted flag is revealed for displaying a visual caution to the user that the speed of the wind is beyond a predefined safe limit. In an embodiment, the wind-resistant umbrella further comprises a supplementary connector disposed at a center of the upper canopy section of the canopy and fixed to the upper end of the pole member. The supplementary connector is configured to generate a whistling sound on receiving a wind of speed exceeding the second predefined wind speed of more than about 20 miles per hour for providing an audible warning to the user that the speed of the wind is beyond a predefined safe limit.

Disclosed herein is also a method for precluding dislodgment of a wind-resistant umbrella from an anchoring location and simultaneously providing one or more warnings, for example, audible and/or visual warnings, to a user. In the method disclosed herein, the wind-resistant umbrella comprising the pole member, the canopy, the flexible ribs, and the load sensitive connectors as disclosed above is provided. The upper canopy section is detachably coupled to the lower canopy section of the canopy of the wind-resistant umbrella using the load sensitive connectors. Upon impact from a wind gust that exceeds a predefined wind speed of more than about 10 mph, the flexible ribs of the wind-resistant umbrella flex inwardly to preclude wind from traveling under the canopy of the wind-resistant umbrella. Upon impact from a wind gust that exceeds a predefined wind speed of more than about 20 mph, one or more of the load sensitive connectors detach to allow wind to flow freely through one or more vents created between the detachably coupled upper canopy section and the lower canopy section between the load sensitive connectors, while generating a sound to provide an audible warning to the user, and to preclude tilting and lifting actions caused by the wind on the wind-resistant umbrella, thereby precluding dislodgment of the wind-resistant umbrella from the anchoring location. In an embodiment, a visual caution is provided to the user that the speed of the wind is beyond a predefined safe limit using at least one of: the highlighted pattern configured on the lower surface of the upper canopy section of the canopy; and the highlighted flag attached to at least one of the load sensitive connectors on the lower surface of the upper canopy section of the canopy as disclosed above.

BRIEF DESCRIPTION OF THE DRAWINGS

The foregoing summary, as well as the following detailed description, is better understood when read in conjunction with the appended drawings. For illustrating the embodiments herein, exemplary constructions of the embodiments are shown in the drawings. However, the embodiments herein are not limited to the specific structures, components, and methods disclosed herein. The description of a structure or a component or a method step referenced by a numeral in a drawing is applicable to the description of that structure or component or method step shown by that same numeral in any subsequent drawing herein.

DETAILED DESCRIPTION

Figure 1A:
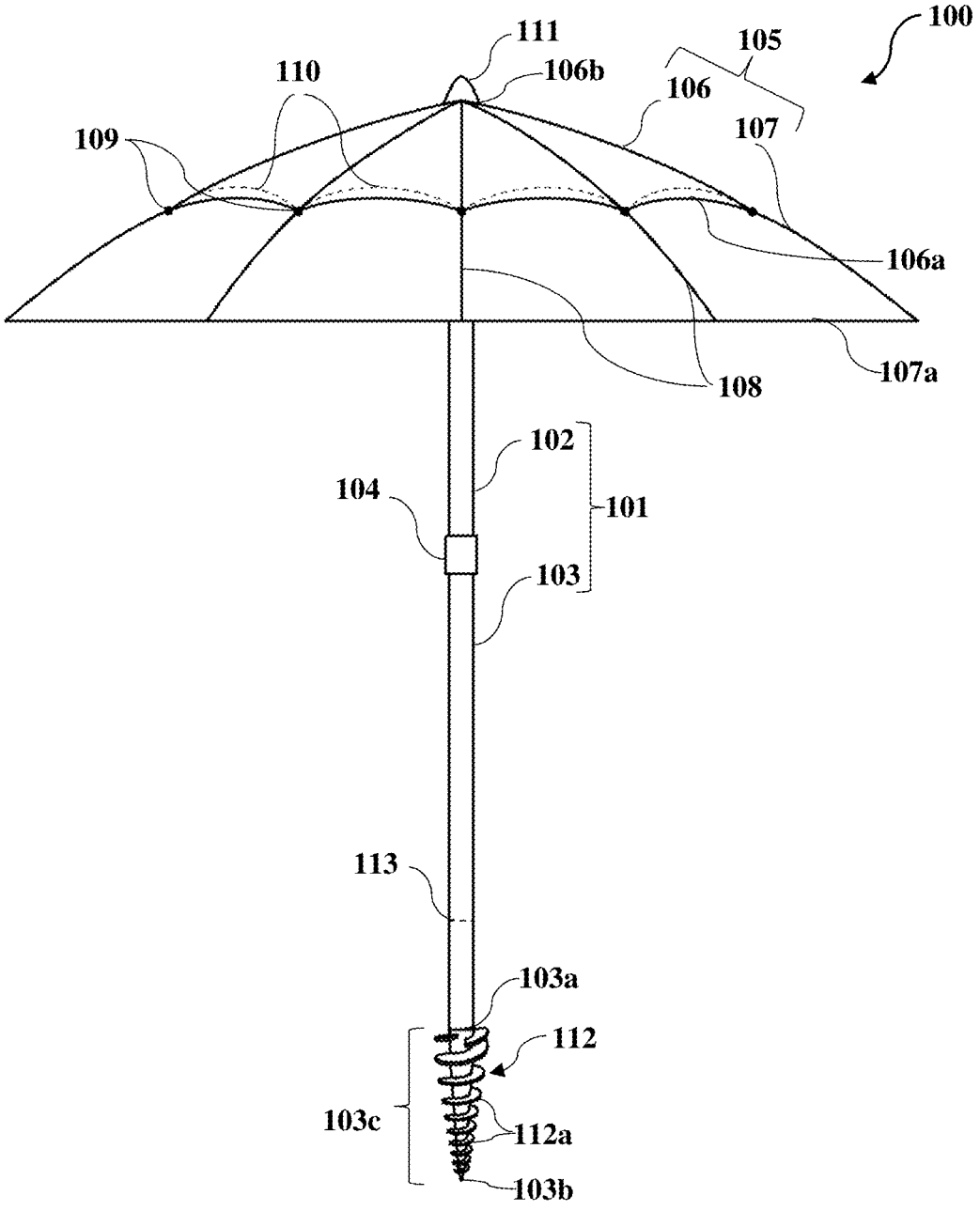
FIG. 1A exemplarily illustrates a front view of a wind-resistant umbrella, according to an embodiment herein.

FIG. 1A exemplarily illustrates a front view of a wind-resistant umbrella 100, according to an embodiment herein. In an example, the wind-resistant umbrella 100 is configured for use as a beach umbrella. The wind-resistant umbrella 100 comprises a pole member 101, a canopy 105, multiple flexible ribs 108, multiple load sensitive connectors 109, and multiple vents 110. In an embodiment, the pole member 101 comprises an upper pole section 102 and a lower pole section 103. The upper pole section 102 is coaxially connected to the lower pole section 103 using a securing assembly 104. The securing assembly 104 is configured to couple and lock the upper pole section 102 to the lower pole section 103 as disclosed in the detailed description of FIGS. 1B-1C. The securing assembly 104 is, for example, a threaded connection assembly, a snap fit connection assembly, a screw fastened connection assembly, etc. The pole member 101 is made, for example, from any one of wood, steel, aluminum, fiber glass, plastics, etc.

In an embodiment, the wind-resistant umbrella 100 further comprises an anchoring element 112, for example, a screw-in style auger, fixed at an anchoring portion 103*c* of the lower pole section 103 of the pole member 101. The anchoring element 112 is, for example, permanently attached or detachably attached to the lower pole section 103 of the pole member 101. In an embodiment, the anchoring element 112 extends from a lower end 103*a* of the lower pole section 103 to a tip 103*b*, that is, a bottom tip, of the lower pole section 103 as exemplarily illustrated in FIG. 1. In an embodiment, the anchoring portion 103*c* of the lower pole section 103 of the pole member 101 extends from the lower end 103*a* of the lower pole section 103 to the tip 103*b* of the lower pole section 103. The anchoring element 112 is configured to securely lodge or anchor the pole member 101 into an anchoring location, for example, sand at a beach, or soil, or the ground. For example, twists 112*a* of the anchoring element 112 screw into the sand and fix the pole member 101 securely into the sand. In an embodiment, the wind-resistant umbrella 100 further comprises a depth indicator 113, for example, a line, configured or marked at a predefined distance from the tip 103*b* of the lower pole section 103 of the pole member 101. For example, the depth indicator 113 is positioned at a predefined distance of about 13 inches from the tip 103*b* of the lower pole section 103 of the pole member 101.

In an embodiment, the depth indicator 113 is configured on the lower pole section 103 of the pole member 101 based on the anchoring location of the wind-resistant umbrella 100. For example, the depth indicator 113 is configured on the lower pole section 103 of the pole member 101 for installation of the wind-resistant umbrella 100 in sand, as the pole member 101 being pulled out is more common in sand. The depth indicator 113 is configured to indicate a predetermined depth to insert the pole member 101 into the anchoring location for maximum safety to preclude the dislodgment of the pole member 101 from the anchoring location. The predetermined depth for inserting the pole member 101 into the anchoring location for maximum safety to preclude the dislodgment of the pole member 101 from the anchoring location is, for example, about 8 inches to about 12 inches. In an example, the predetermined depth for inserting the pole member 101 in sand is about 12 inches. That is, about 12 inches of the pole member 101 is positioned below ground level. In another example, the predetermined depth for inserting the pole member 101 in soil is about 8 inches. That is, about 8 inches of the pole member 101 is positioned below ground level. The depth indicator 113 on the lower pole section 103 instructs users about the correct depth to install the pole member 101 into the anchoring location. As used herein, the term "user" refers to a person who operates and uses the wind-resistant umbrella 100.

Figure 7:
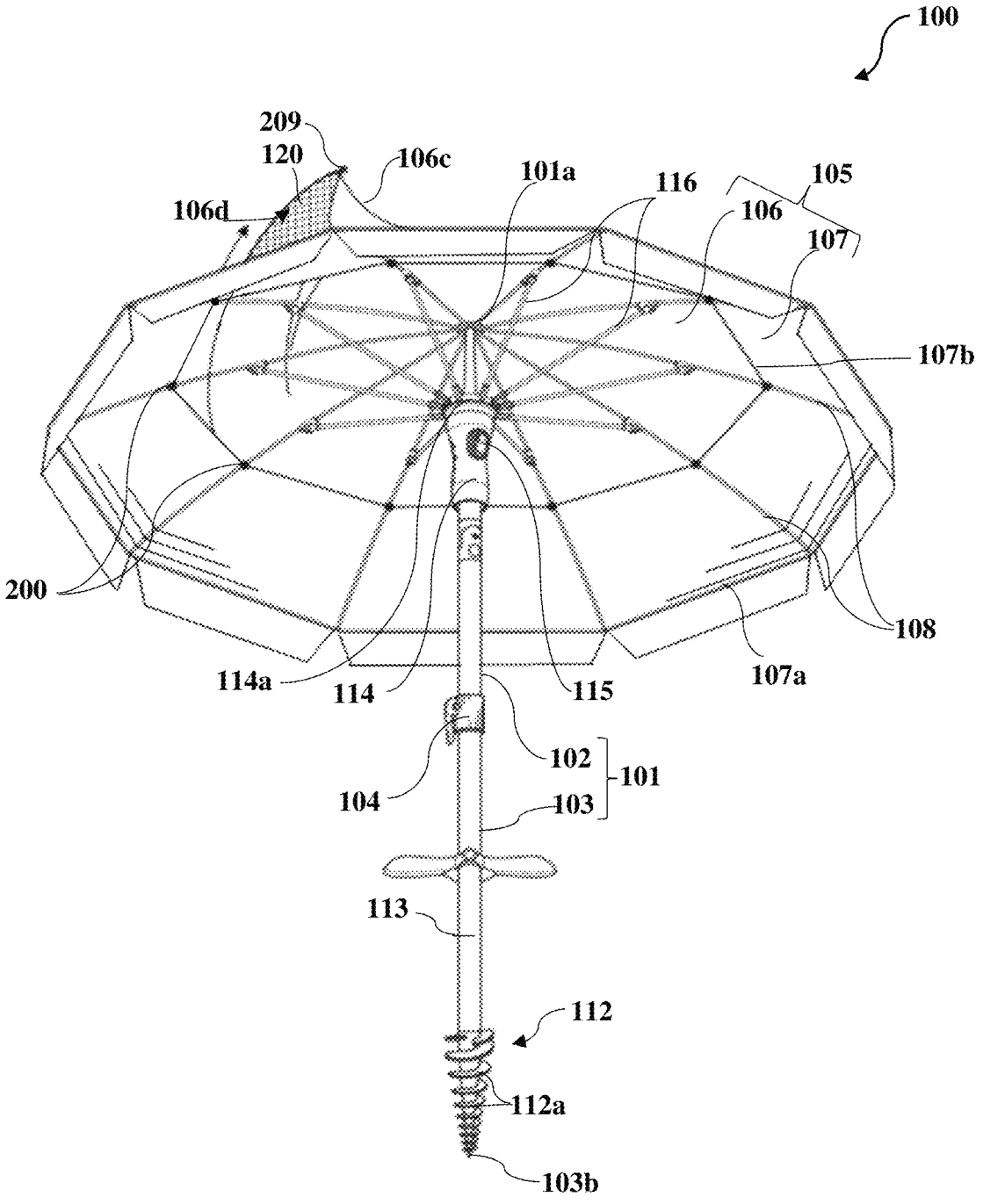
FIG. 7 exemplarily illustrates a bottom perspective view of the wind-resistant umbrella, showing separation of one panel of the upper canopy section from the lower canopy section of the canopy by detachment of one of the load sensitive connectors and a highlighted pattern configured to display a visual caution to a user, according to an embodiment herein.
Figure 8:
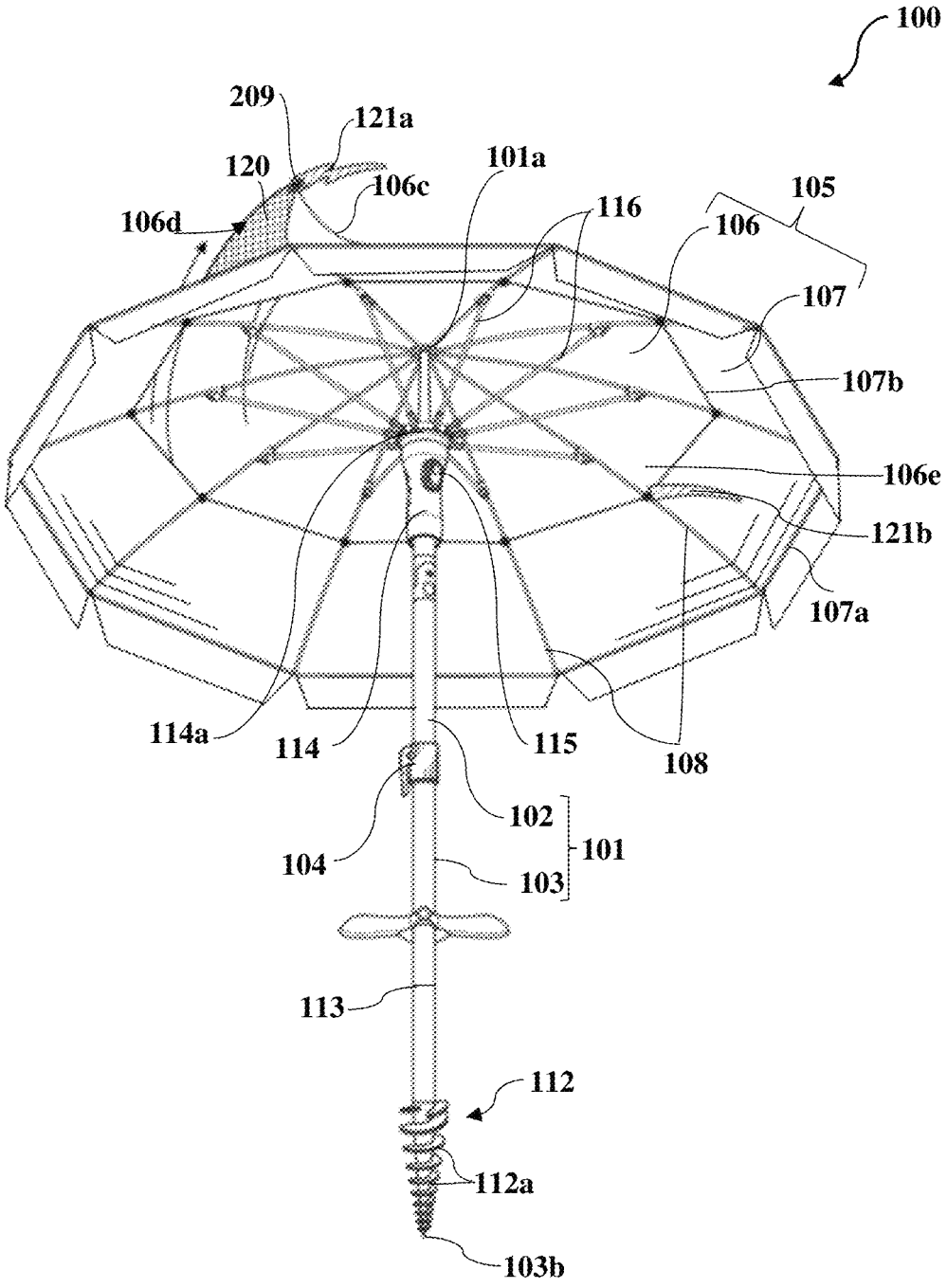
FIG. 8 exemplarily illustrates a bottom perspective view of the wind-resistant umbrella, showing separation of one panel of the upper canopy section from the lower canopy section of the canopy by detachment of one of the load sensitive connectors and highlighted flags configured to display a visual caution to a user, according to an embodiment herein.

The canopy 105 of the wind-resistant umbrella 100 is attached to an upper end 101*a* of the pole member 101 as exemplarily illustrated in FIGS. 7-8. The canopy 105 comprises an upper canopy section 106 and a lower canopy section 107. The upper canopy section 106 is detachably coupled to the lower canopy section 107. When the wind-resistant umbrella 100 is fully expanded and in normal wind conditions, in an embodiment, the upper canopy section 106 is detachably coupled to the lower canopy section 107 using the load sensitive connectors 109. In an embodiment, the load sensitive connectors 109 are fixedly attached to the upper canopy section 106 and between the upper canopy section 106 and the lower canopy section 107. The canopy 105 is, for example, a dual-layered canopy specifically designed such that the upper canopy section 106 detaches from the lower canopy section 107 at connection points or at the load sensitive connectors 109 to allow large volumes of wind or air to flow through the lower canopy section 107. In an embodiment, the wind-resistant umbrella 100 comprises two tiers of fabric designed for the upper canopy section 106 and the lower canopy section 107 of the canopy 105 respectively. The canopy 105 is made from durable, weatherproof materials, for example, polyester, canvas, acrylic, polyvinyl chloride (PVC), nylon, polyester-nylon blend, marine-grade vinyl, silk, rayon, etc.

A surface area of the detachably coupled upper canopy section 106 is of a predefined size with respect to a surface area of the lower canopy section 107. The predefined size of the surface area of the detachably coupled upper canopy section 106 is, for example, between about 45% and about 60% of the surface area of the lower canopy section 107. That is, the detachably coupled upper canopy section 106 is, for example, from about 45% to about 60% the surface area of the lower canopy section 107. This ratio is dependent on the overall diameter of the canopy 105 and is configured to maximize wind flow. In an example, the diameter of the upper canopy section 106 of a 7-foot wind-resistant umbrella 100 is about 3.5 feet. In an embodiment, the lower canopy section 107 is coaxially positioned with respect to positioning of the upper canopy section 106. The flexible ribs 108 of the wind-resistant umbrella 100 extend radially from the upper end 101*a* of the pole member 101 towards a lower peripheral edge 107*a* of the lower canopy section 107 of the canopy 105 as exemplarily illustrated in FIGS. 7-8. The flexible ribs 108 are thin, flexible wires. The flexible ribs 108 are configured to support the upper canopy section 106 and the lower canopy section 107 of the canopy 105 and flex inwardly at a predefined wind speed of, for example, more than about 10 miles per hour (mph). The flexible ribs 108 are configured to flex inwardly to preclude the wind from traveling under the canopy 105.

The load sensitive connectors 109 of the wind-resistant umbrella 100 are positioned on the flexible ribs 108 and attached at a lower peripheral edge 106*a* of the upper canopy section 106 and proximal to an upper peripheral edge 107*b* of the lower canopy section 107 exemplarily illustrated in FIGS. 7-8. As used herein, "load sensitive connectors" refer to connecting devices comprising mating parts that detach or disengage from each other when subjected to a load of a gust of wind having a speed of, for example, more than about 20 mph. In an embodiment, one load sensitive connector 109 is positioned on each flexible rib 108 as exemplarily illustrated in FIG. 1A. In another prophetic embodiment (not shown), at least two load sensitive connectors 109 are positioned on each flexible rib 108. The load sensitive connectors 109 are configured to detachably couple the upper canopy section 106 to the lower canopy section 107 of the canopy 105. The upper canopy section 106 is configured to partially overlap the lower canopy section 107 along the load sensitive connectors 109. In an embodiment, the load sensitive connectors 109 are, for example, specifically engineered snap fasteners made of metal or plastic, that are detachably attached and perimetrically positioned along the upper canopy section 106 of the canopy 105. In an example, the load sensitive connectors 109 are attached to the upper canopy section 106 and the lower canopy section 107 of the canopy 105. Other examples of the load sensitive connectors 109 comprise snap connectors, hook and loop fasteners such as Velcro® fasteners, snap fasteners with interlocking discs as disclosed in Applicant's non-provisional patent application titled "Wind-resistant Beach Umbrella", application Ser. No. 16/945,172, filed on Jul. 31, 2020, etc., where a force required for separation of the load sensitive connectors 109 can be measured and is consistent. For example, the load sensitive connectors 109 separate or detach under an X amount of a pulling force typically generated when wind speeds exceed Y mph, where "X" is in a range of about 17 Newtons to about 21 Newtons and "Y" is more than about 20 mph.

In another embodiment as exemplarily illustrated in FIGS. 2-8, the load sensitive connectors 200 constitute an audible connection assembly, each comprising a bracket assembly 201 and a bolt assembly 209 as disclosed in the detailed descriptions of FIGS. 2-8. For purposes of illustration, the detailed description refers to the load sensitive connectors being connection assemblies 200 comprising respective bracket assemblies 201 and bolt assemblies 209 as exemplarily illustrated in FIGS. 2-8, or snap fasteners 109, hook and loop fasteners, etc.; however, the scope of the wind-resistant umbrella 100 is not limited to these load sensitive connectors 109 and 200, but may be extended to include other functionally equivalent mating fasteners, connectors, or clips configured to detachably couple the upper canopy section 106 and the lower canopy section 107 of the canopy 105.

The vents 110 of the wind-resistant umbrella 100 are created between the detachably coupled upper canopy section 106 and the lower canopy section 107 of the canopy 105 between the load sensitive connectors 109. One or more of the load sensitive connectors 109 are configured to detach upon impact from a wind gust that exceeds a predefined wind speed of more than about 20 mph, to allow wind to flow freely through one or more of the vents 110 created between the upper canopy section 106 and the lower canopy section 107 and to preclude tilting and lifting actions caused by the wind on the wind-resistant umbrella 100, thereby precluding dislodgment of the wind-resistant umbrella 100 from the anchoring location. The detachment of one or more of the load sensitive connectors 109, upon impact from a wind that exceeds the predefined wind speed of more than about 20 mph, allows the wind to flow through and between the upper canopy section 106 and the lower canopy section 107 of the canopy 105.

In an embodiment, the wind-resistant umbrella 100 further comprises a supplementary connector 111 disposed at the upper end 101*a* of the pole member 101 exemplarily illustrated in FIGS. 7-8. The supplementary connector 111 is, for example, a finial connector. In an embodiment, the supplementary connector 111 is not load sensitive in function. The supplementary connector 111 is configured to be semi-permanently fixed at a center 106*b* of the upper canopy section 106 of the canopy 105. The supplementary connector 111 is configured to generate sounds, for example, whistle sounds, for providing an audible warning to a user that the speed of the wind is beyond a predefined safe limit. The predefined safe limit range is, for example, from about 19 mph to about 24 mph or Beaufort number 5 of the Beaufort wind force scale. The range where wind speeds start to exceed a safe limit is, for example, from about 25 mph to about 31 mph or Beaufort number 6 of the Beaufort wind force scale.

Figure 1B:
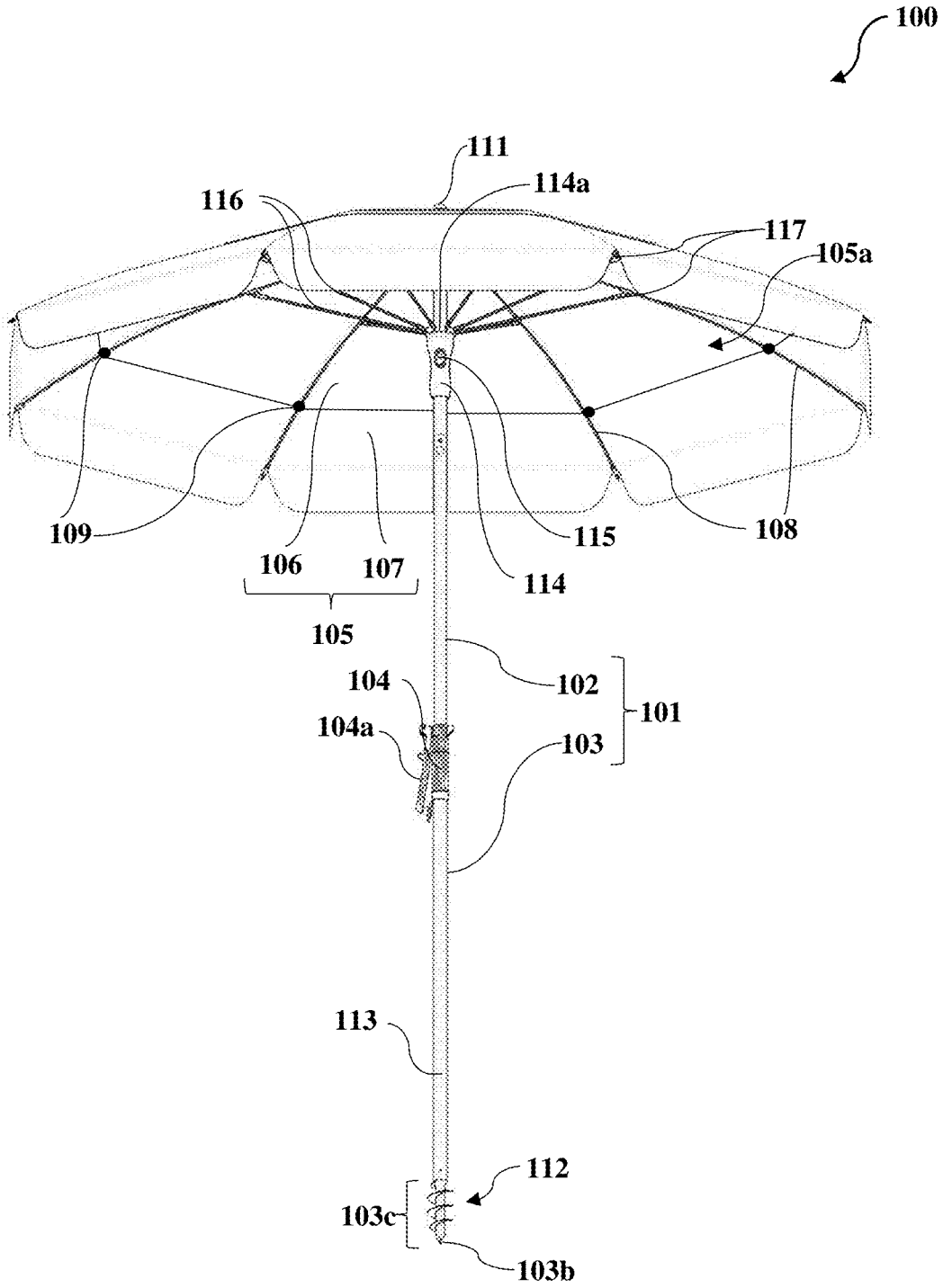
FIGS. 1B-1C exemplarily illustrate bottom perspective views of the wind-resistant umbrella, showing a securing assembly operably coupled to a pole member of the wind-resistant umbrella, according to an embodiment herein.
Figure 1C:
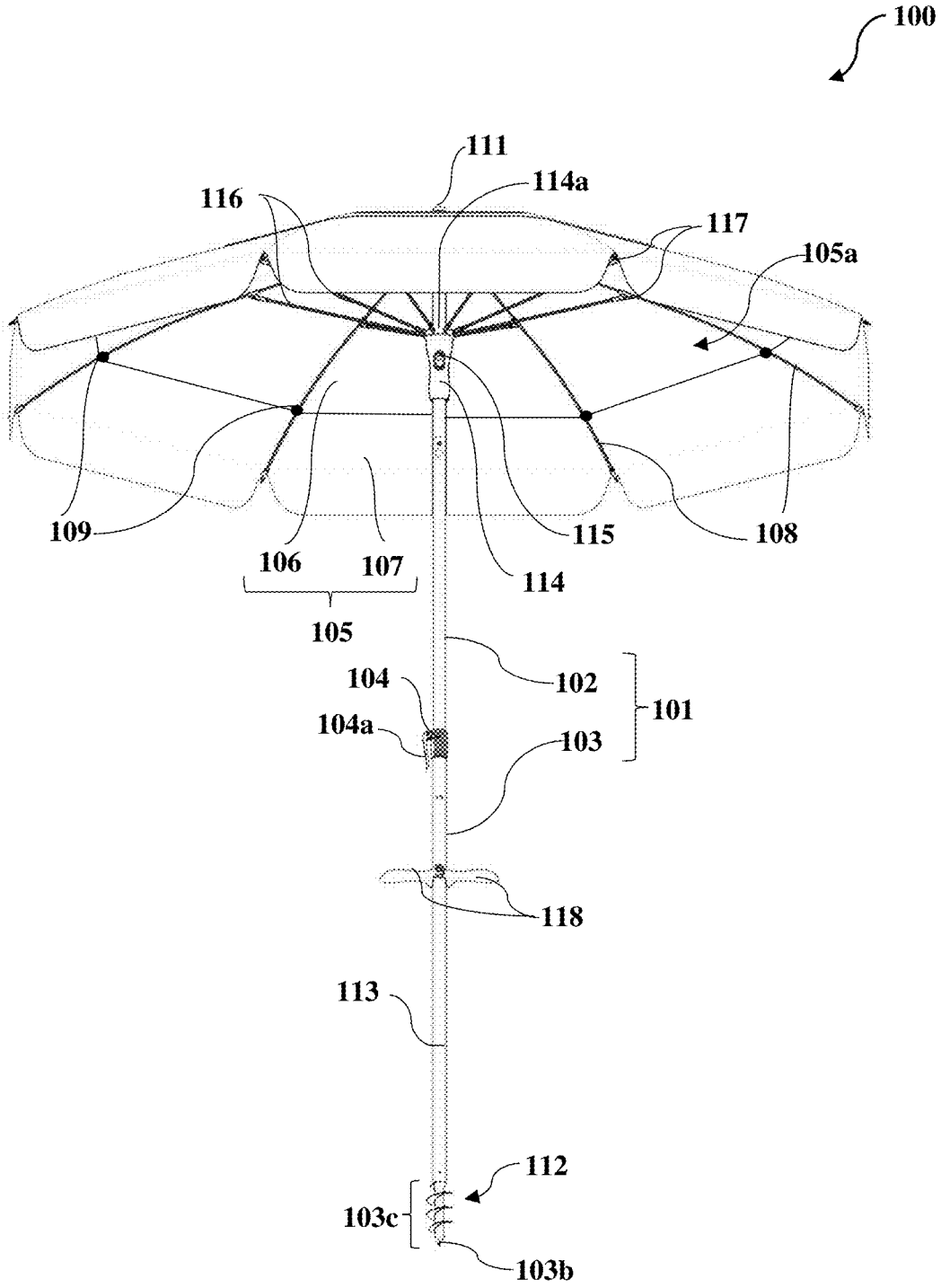

FIGS. 1B-1C exemplarily illustrate bottom perspective views of the wind-resistant umbrella 100, showing a securing assembly 104 operably coupled to the pole member 101 of the wind-resistant umbrella 100, according to an embodiment herein. The securing assembly 104 is configured to operate as a coupler that couples the upper pole section 102 to the lower pole section 103 of the pole member 101. In an embodiment, the upper pole section 102 is inserted into an opening (not shown) of a hollow, lower pole section 103. In an embodiment as exemplarily illustrated in FIG. 1B, the upper pole section 102 is telescopically positioned in the lower pole section 103. In this embodiment, the securing assembly 104 allows the upper pole section 102 to slide in an upward direction and a downward direction inside the lower pole section 103 of the pole member 101 to adjust the height of the pole member 101. In an embodiment as exemplarily illustrated in FIG. 1B, the securing assembly 104 comprises a locking lever 104*a* configured to lock the upper pole section 102 inside the lower pole section 103 in position at a required height. In another embodiment as exemplarily illustrated in FIG. 1C, a lower end (not shown) of the upper pole section 102 is tapered to fit inside the opening (not shown) of the hollow, lower pole section 103. In this embodiment, the upper pole section 102 is secured to the lower pole section 103 of the pole member 101 using the locking lever 104*a* of the securing assembly 104. Lifting the locking lever 104*a* of the securing assembly 104 exemplarily illustrated in FIGS. 1B-1C, in an upward direction unlocks and decouples the upper pole section 102 from the lower pole section 103 of the pole member 101. Pushing the locking lever 104*a* in a downward direction locks and couples the upper pole section 102 to the lower pole section 103 of the pole member 101.

In an embodiment, a runner 114 is slidably positioned on the upper pole section 102 of the pole member 101 as exemplarily illustrated in FIGS. 1B-1C. The runner 114 is a hub configured to open and close the canopy 105 of the wind-resistant umbrella 100 as disclosed in the detailed description of FIG. 1D. Multiple stretchers 116 extend radially from an upper end 114*a* of the runner 114 and connect to the flexible ribs 108 of the wind-resistant umbrella 100 via jointed metal hinges, also referred to as joiners 117. The stretchers 116 extend from the upper end 114*a* of the runner 114 and terminate at the joiners 117. In an embodiment as exemplarily illustrated in FIGS. 1B-1C, the flexible ribs 108 run along a lower surface 105*a* of the canopy 105. The runner 114 is configured to expand the stretchers 116. The runner 114 slides up the upper pole section 102 of the pole member 101, locks onto a top spring element (not shown), and in operable communication with the stretchers 116, opens the canopy 105 of the wind-resistant umbrella 100 to a fully, expanded open position. The runner 114 comprises a release element, for example, a button 115, configured to release the runner 114 from the top spring element. On being released from the top spring element, the runner 114 slides down the upper pole section 102 of the pole member 101, and in operable communication with the stretchers 116, closes the canopy 105 of the wind-resistant umbrella 100.

In an embodiment, a handle assembly 118 is positioned on the lower pole section 103 of the pole member 101 as exemplarily illustrated in FIG. 1C. The handle assembly 118 allows a user to twist the anchoring element 112 at the anchoring portion 103*c* of the lower pole section 103 of the pole member 101 into the anchoring location, for example, sand on the beach, to securely lodge the pole member 101 into the anchoring location. The user grips the pole member 101 by the handle assembly 118 and twists the anchoring element 112 into the anchoring location till the lower pole section 103 of the pole member 101 reaches the correct depth indicated by the depth indicator 113 for lodging the pole member 101 in the anchoring location.

Figure 1D:
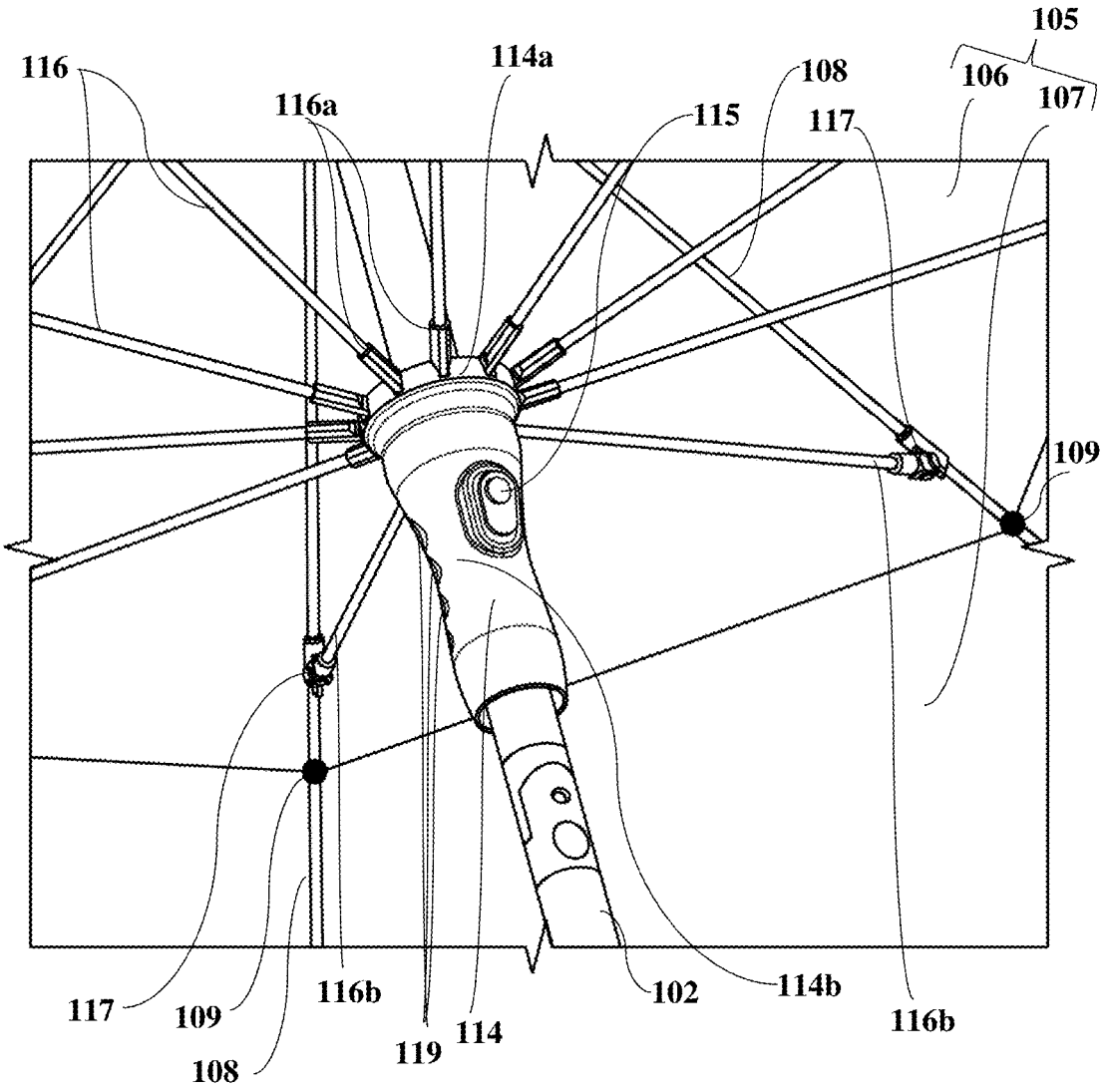
FIG. 1D exemplarily illustrates a partial, enlarged perspective view, showing a runner configured to open and close a canopy of the wind-resistant umbrella, according to an embodiment herein.

FIG. 1D exemplarily illustrates a partial, enlarged perspective view, showing the runner 114 configured to open and close the canopy 105 of the wind-resistant umbrella 100 shown in FIGS. 1B-1C, according to an embodiment herein. As exemplarily illustrated in FIG. 1D, the stretchers 116 connect to and extend radially from the upper end 114*a* of the runner 114. Each of the stretchers 116 comprises a first end 116*a* and a second end 116*b*. The first end 116*a* of each stretcher 116 is connected to the upper end 114*a* of the runner 114. The second end 116*b* of each stretcher 116 is connected to a flexible rib 108 of the wind-resistant umbrella 100 using a jointed metal hinge or joiner 117. The joiners 117 hinge the stretchers 116 to the flexible ribs 108 on the lower surface 105*a* of the canopy 105 as exemplarily illustrated in FIGS. 1B-1C. In an embodiment as exemplarily illustrated in FIG. 1D, the runner 114 further comprises gripping elements 119 configured on an outer surface 114*b* of the runner 114. The gripping elements 119 configured, for example, as finger grips, provide a grip to a user's fingers on the runner 114 during opening and closing of the canopy 105 using the runner 114.

Figure 2:
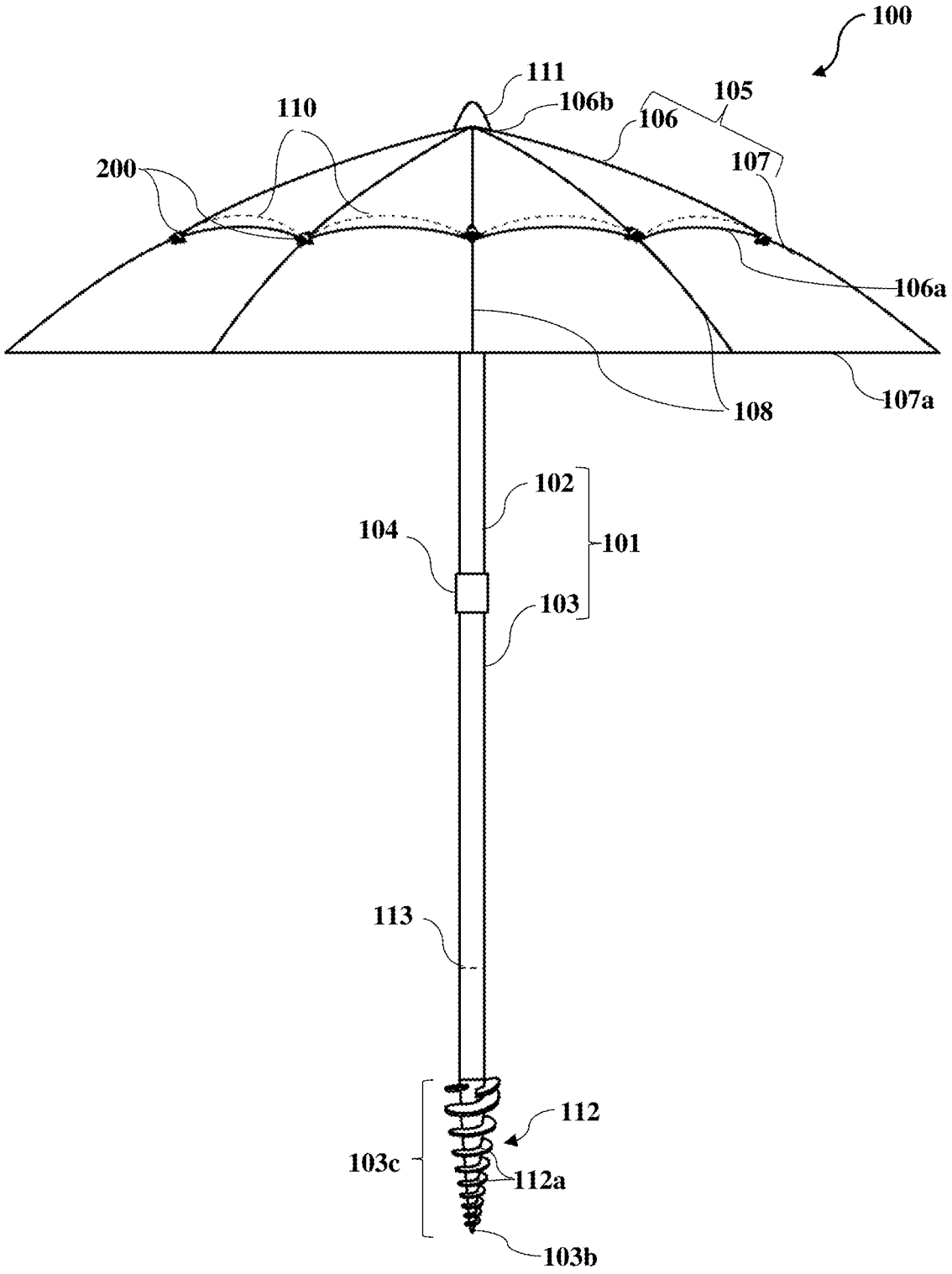
FIG. 2 exemplarily illustrates a front view of the wind-resistant umbrella, according to another embodiment herein.
Figure 3:
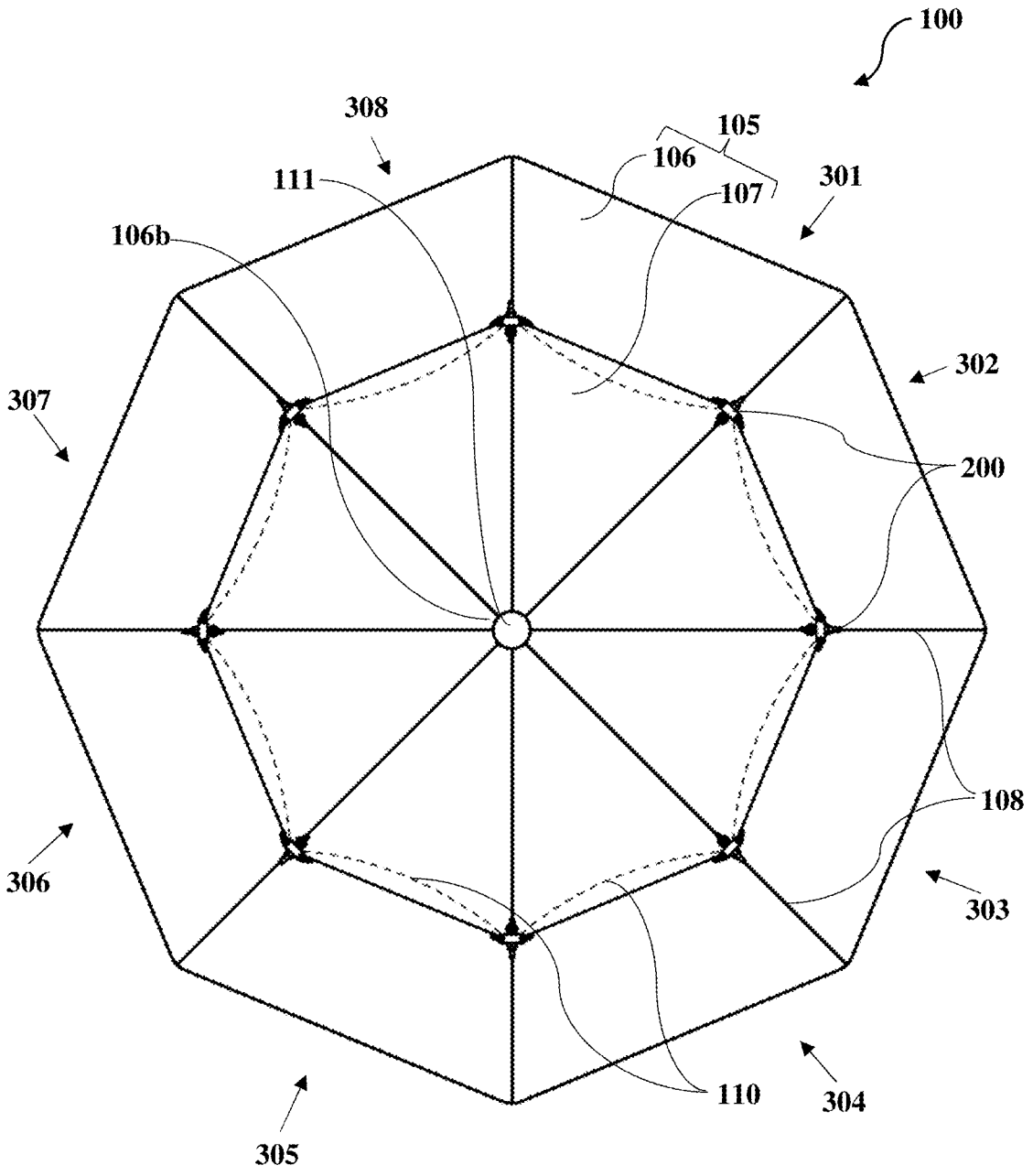
FIG. 3 exemplarily illustrates a top view of the wind-resistant umbrella shown in FIG. 2, according to an embodiment herein.

FIGS. 2-3 exemplarily illustrate a front view and a top view respectively, of the wind-resistant umbrella 100, according to another embodiment herein. FIG. 2 exemplarily illustrates the pole member 101, the canopy 105, the flexible ribs 108, and the vents 110 as disclosed in the detailed description of FIG. 1A. The lower canopy section 107 of the canopy 105 is positioned coaxial to a position of the upper canopy section 106 of the canopy 105 about the pole member 101. FIG. 2 also exemplarily illustrates load sensitive connectors 200 of another type, according to another embodiment herein. In this embodiment, instead of snap fasteners, the load sensitive connectors 200 are configured to detachably couple the upper canopy section 106 to the lower canopy section 107 of the canopy 105, where the upper canopy section 106 partially overlaps the lower canopy section 107 along the load sensitive connectors 200.

The upper canopy section 106 partially overlaps the lower canopy section 107 to allow the upper canopy section 106 to receive rain water and transfer the rain water over to the lower canopy section 107 to preclude the rain water from flowing through the vents 110 defined between the upper canopy section 106 and the lower canopy section 107. The vents 110 are formed between the upper canopy section 106 and the lower canopy section 107 between each of the load sensitive connectors 200 to counteract high-speed winds. A ratio of fabric size of the upper canopy section 106 to the lower canopy section 107 determines the size of each of the vents 110 in a static state, and therefore the volume of air that can flow through each of the vents 110. Based on wind tunnel testing conducted on the canopy 105, the ratio of the upper canopy section 106 to the lower canopy section 107 is, for example, between about 45% and about 60% of the total surface area of the lower canopy section 107. In this embodiment, each of the load sensitive connectors 200 comprises a bracket assembly 201 and a bolt assembly 209 as disclosed on the detailed descriptions of FIGS. 4A-4J and FIG. 5. The load sensitive connectors 200, each comprising the bracket assembly 201 and the bolt assembly 209, constitute an audible connection assembly as exemplarily illustrated in FIG. 3, for detachably coupling the upper canopy section 106 to the lower canopy section 107 of the canopy 105 and for providing an audible warning to a user. The upper canopy section 106 and the lower canopy section 107 of the canopy 105 form, for example, about eight panels 301, 302, 303, 304, 305, 306, 307, and 308, as exemplarily illustrated in FIG. 3. The individual panels 301, 302, 303, 304, 305, 306, 307, and 308 are sewn to the flexible ribs 108 of the wind-resistant umbrella 100.

Figure 4A:
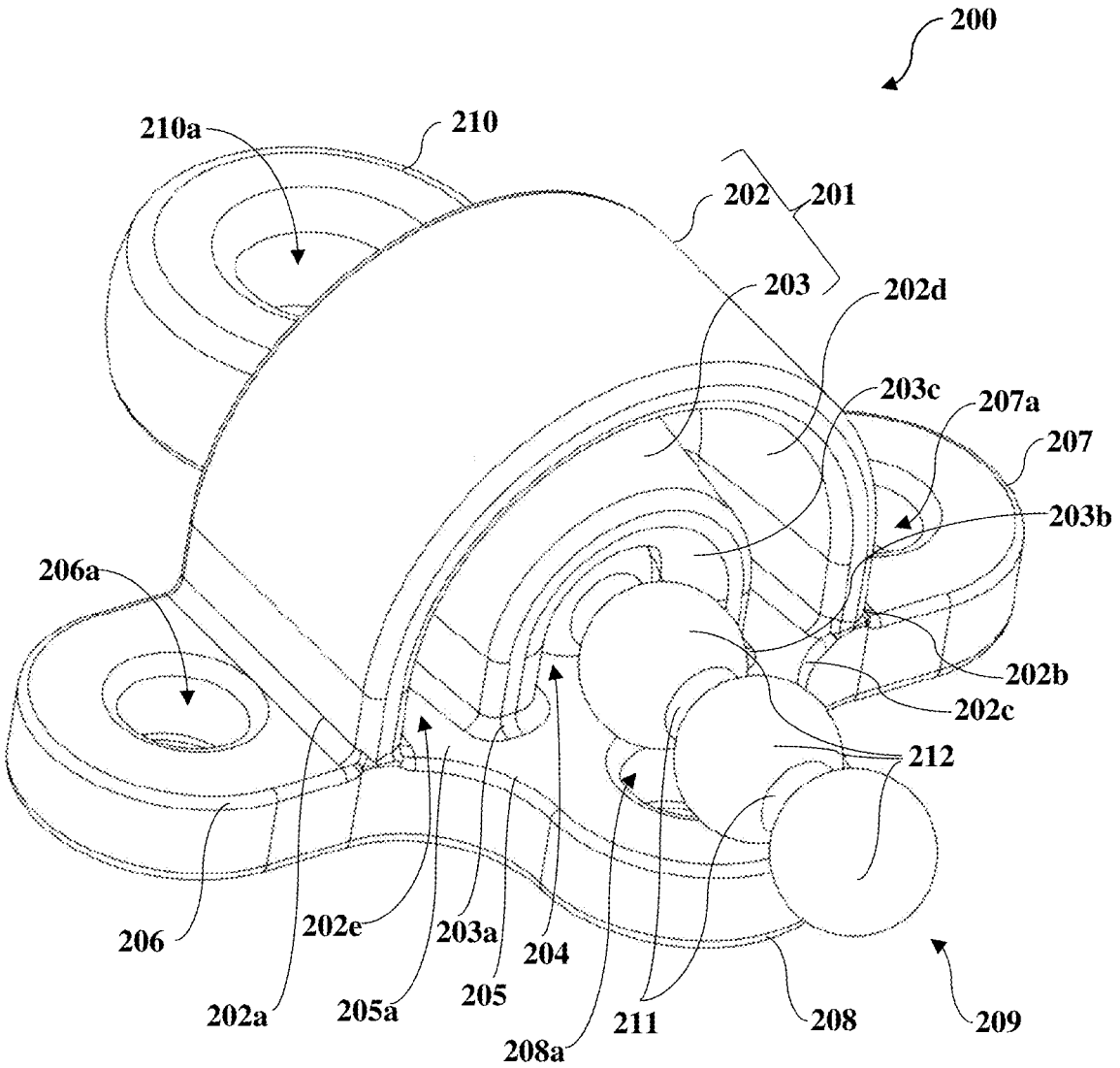
FIG. 4A exemplarily illustrates a bottom perspective view of a load sensitive connector used in the wind-resistant umbrella shown in FIGS. 2-3, according to an embodiment herein.
Figure 4B:
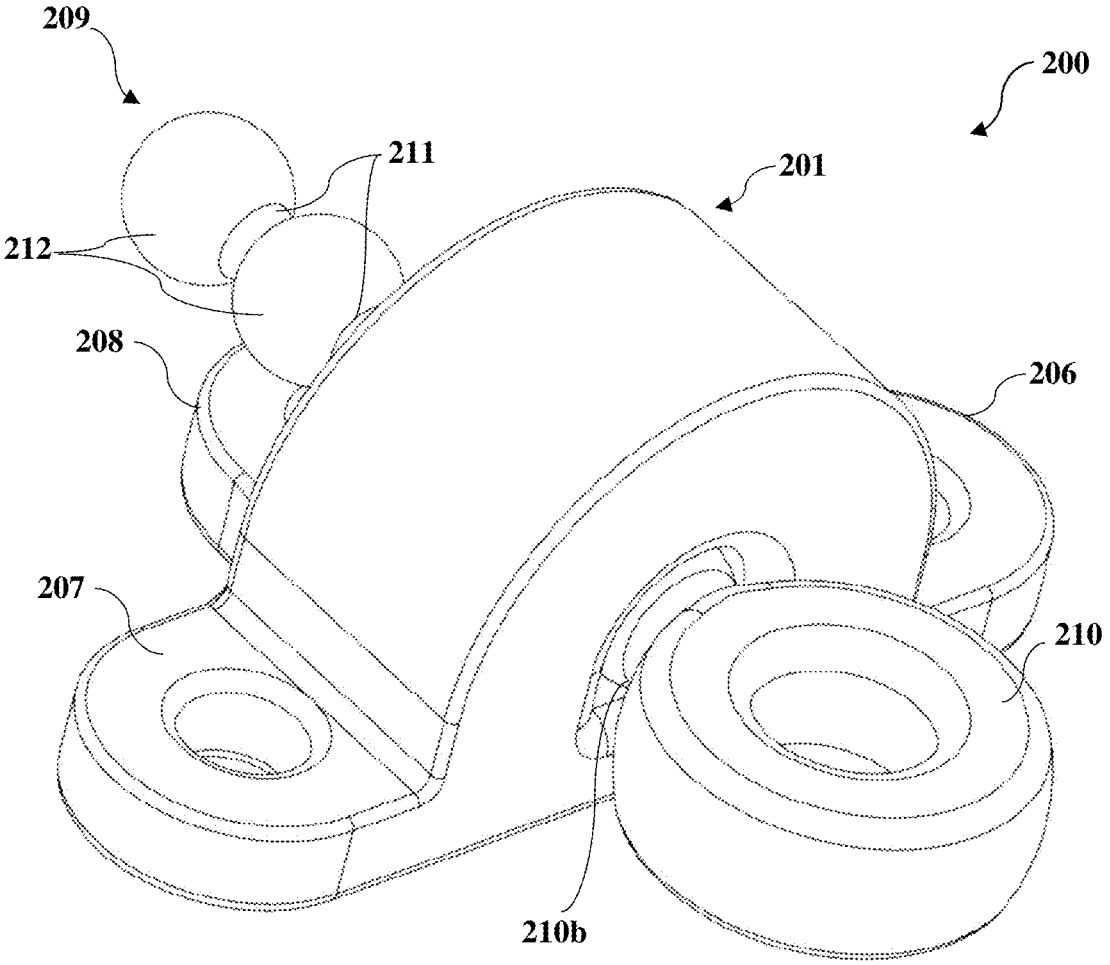
FIG. 4B exemplarily illustrates a top perspective view of the load sensitive connector shown in FIG. 4A, according to an embodiment herein.
Figure 4C:
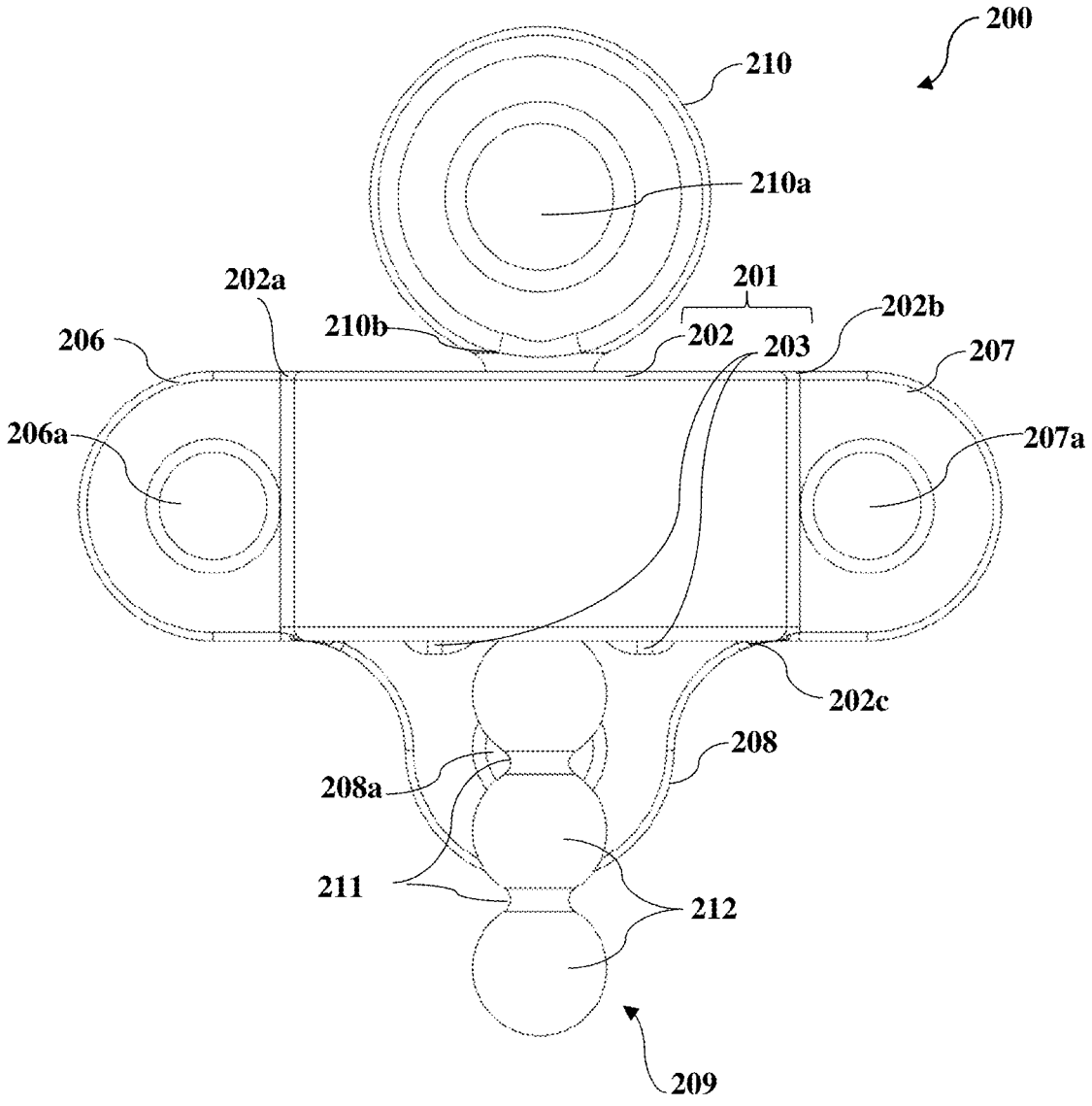
FIG. 4C exemplarily illustrates a front elevation view of the load sensitive connector shown in FIGS. 4A-4B, according to an embodiment herein.
Figure 4D:
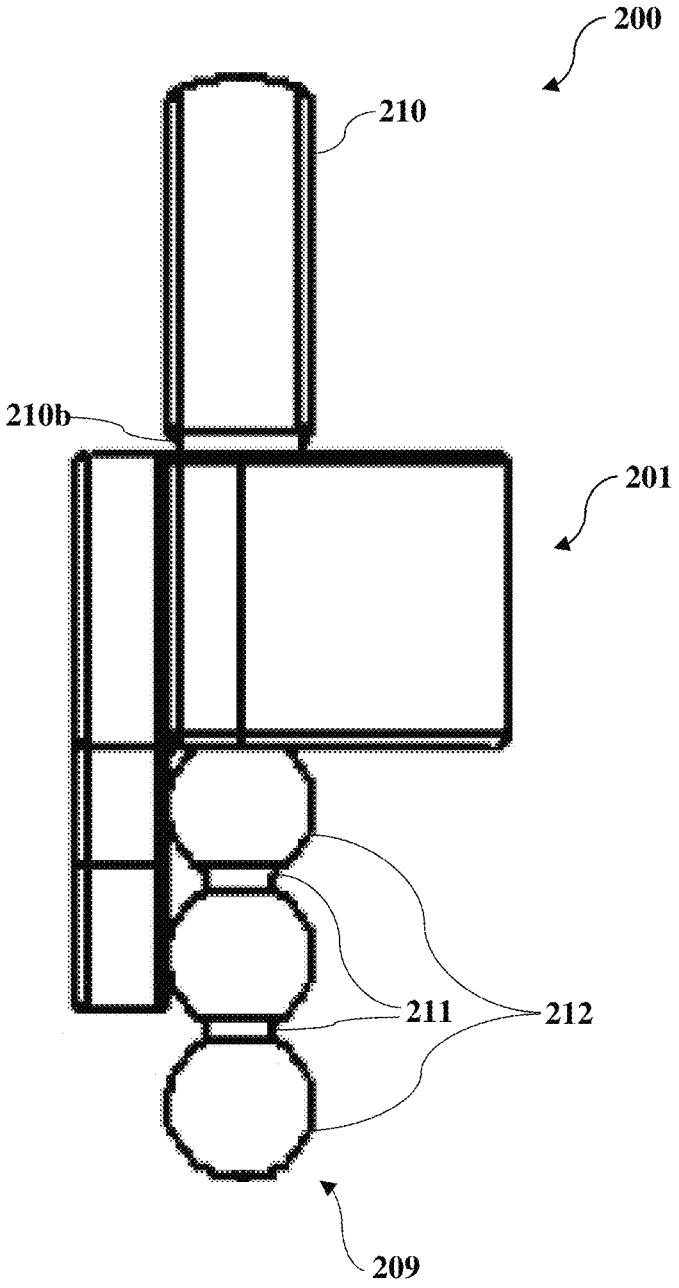
FIG. 4D exemplarily illustrates a side elevation view of the load sensitive connector shown in FIGS. 4A-4B, according to an embodiment herein.
Figure 4E:
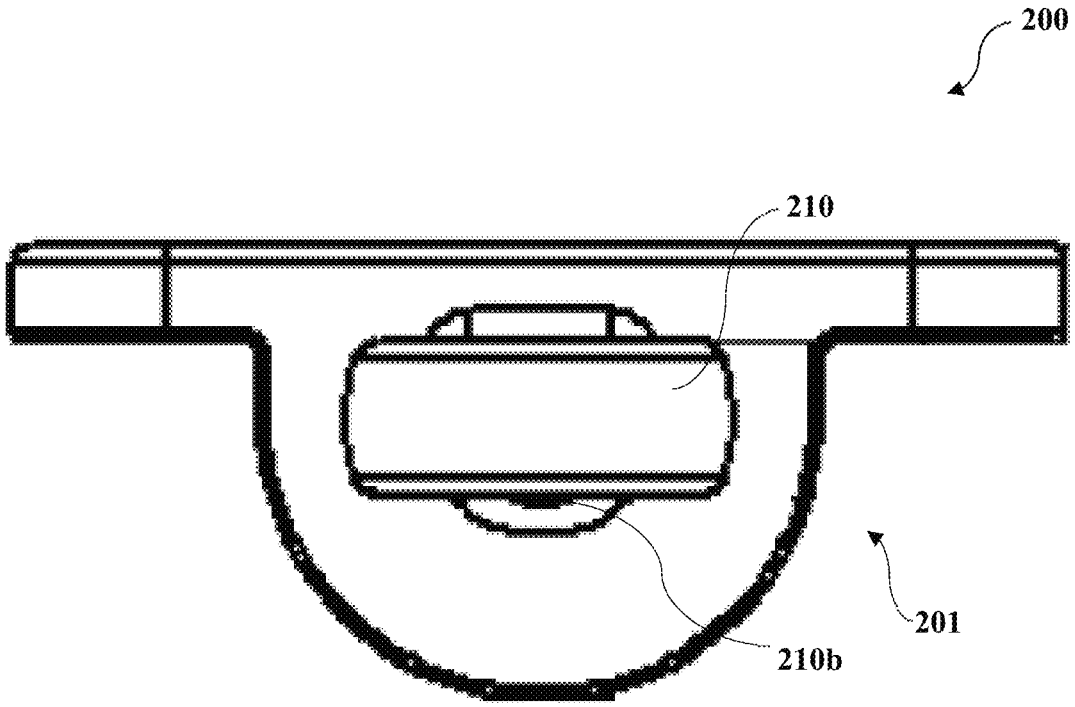
FIG. 4E exemplarily illustrates a top plan view of the load sensitive connector shown in FIGS. 4A-4B, according to an embodiment herein.
Figure 4F:
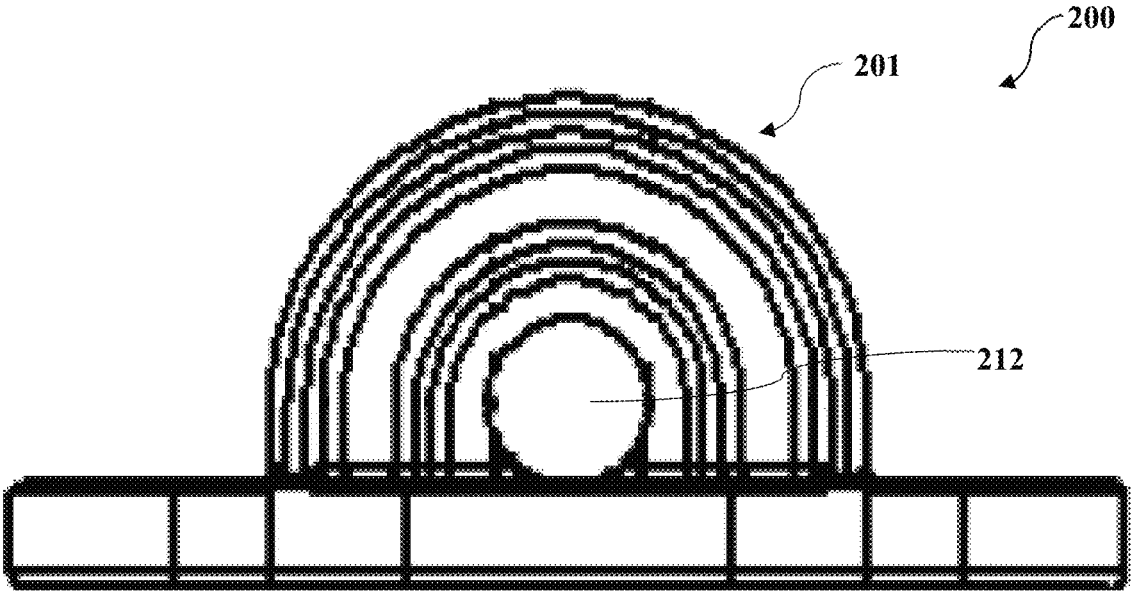
FIG. 4F exemplarily illustrates a bottom elevation view of the load sensitive connector shown in FIGS. 4A-4B, according to an embodiment herein.

FIGS. 4A-4B exemplarily illustrate a bottom perspective view and a top perspective view respectively, of a load sensitive connector 200 used in the wind-resistant umbrella 100 shown in FIGS. 2-3, according to an embodiment herein. The load sensitive connector 200 is made, for example, from injection molded plastic(s) or cast metals such as aluminum. The load sensitive connector 200 is configured in one of multiple sizes that vary based on manufacturing capabilities. A length or width dimension of the load sensitive connector 200 is, for example, about 0.75 inches. The diameter of the load sensitive connector 200 is, for example, about 0.5 inches. In this embodiment, the load sensitive connector 200 comprises a bracket assembly 201 and a bolt assembly 209. In an embodiment, the bracket assembly 201 comprises a base member 205, an outer bracket 202, an inner bracket 203, and at least two flanges, for example, three flanges 206, 207, and 208 as exemplarily illustrated in FIGS. 4A-4C, FIG. 4G, and FIGS. 4I-4J. In an example, the outer bracket 202 and the inner bracket 203 of the bracket assembly 201 are configured similar to saddle clamps. The outer bracket 202 is rigidly attached to the base member 205. The outer bracket 202 comprises a space 202*e* defined by an inner wall 202*d* of the outer bracket 202 and an upper surface 205*a* of the base member 205.

The inner bracket 203 is coaxially disposed on the upper surface 205*a* of the base member 205, within the space 202*e* defined by the outer bracket 202 and the upper surface 205*a* of the base member 205. Opposing sides 203*a* and 203*b* of the inner bracket 203 are rigidly attached to the upper surface 205*a* of the base member 205. The inner bracket 203 comprises an opening 204 defined by an inner wall 203*c* of the inner bracket 203. The flanges 206 and 207 extend from at least two diametrically opposite sides 202*a* and 202*b* of the outer bracket 202. In an embodiment, the bracket assembly 201 further comprises a supplementary flange 208 extending from another side 202*c* of the outer bracket 202. In an embodiment, the flanges 206, 207, and 208 comprise openings 206*a*, 207*a*, and 208*a* respectively, configured to receive fastening elements, for example, ties 214*a* exemplarily illustrated in FIG. 5, for attaching the flanges 206, 207, and 208 to the lower canopy section 107 of the canopy 105 as exemplarily illustrated in FIG. 5.

The bolt assembly 209 is in engageable communication with the bracket assembly 201. In an embodiment, the bolt assembly 209 comprises a head member 210 and an elongate member 211. In an embodiment, the head member 210 comprises an opening 210*a* configured to receive a fastening element, for example, a tie 214*b* exemplarily illustrated in FIG. 5, for attaching the head member 210 to the upper canopy section 106 of the canopy 105 as exemplarily illustrated in FIG. 5. The elongate member 211 is a shaft extending from a lower end 210*b* of the head member 210. The elongate member 211 is configured to be inserted into the opening 204 of the inner bracket 203 of the bracket assembly 201 for coupling the upper canopy section 106 to the lower canopy section 107 of the canopy 105 exemplarily illustrated in FIG. 5. In an embodiment, the bolt assembly 209 further comprises multiple sound generating elements 212 configured along a length of the elongate member 211 of the bolt assembly 209. In an embodiment, the sound generating elements 212 are configured, for example, as spherical elements or beads rigidly attached along the length of the elongate member 211 as exemplarily illustrated in FIGS. 4A-4D and FIGS. 4G-4J.

FIGS. 4C-4G exemplarily illustrate a front elevation view, a side elevation view, a top plan view, a bottom elevation view, and a bottom perspective view respectively, of the load sensitive connector 200 shown in FIGS. 4A-4B, according to an embodiment herein. The front elevation view in FIG. 4C exemplarily illustrates the flanges 206, 207, and 208 with their respective openings 206*a*, 207*a*, and 208*a*, extending outwardly from the sides 202*a*, 202*b*, and 202*c* of the outer bracket 202 of the bracket assembly 201 respectively. The front elevation view and the side elevation view in FIGS. 4C-4D respectively, illustrate the bolt assembly 209 in engageable communication with the bracket assembly 201, where the elongate member 211 of the bolt assembly 209 extends from the lower end 210*b* of the head member 210 of the bolt assembly 209. The top plan view in FIG. 4E exemplarily illustrates the positioning of the head member 210 of the bolt assembly 209 in the bracket assembly 201. The bottom elevation view in FIG. 4F exemplarily illustrates one of the sound generating elements 212 of the bolt assembly 209 extending out of the bracket assembly 201. The bottom perspective view in FIG. 4G exemplarily illustrates the outer bracket 202 and the inner bracket 203 of the bracket assembly 201. The bottom perspective view in FIG. 4G also illustrates the elongate member 211 of the bolt assembly 209 inserted into and extending from the opening 204 of the inner bracket 203 of the bracket assembly 201.

Figure 4G:
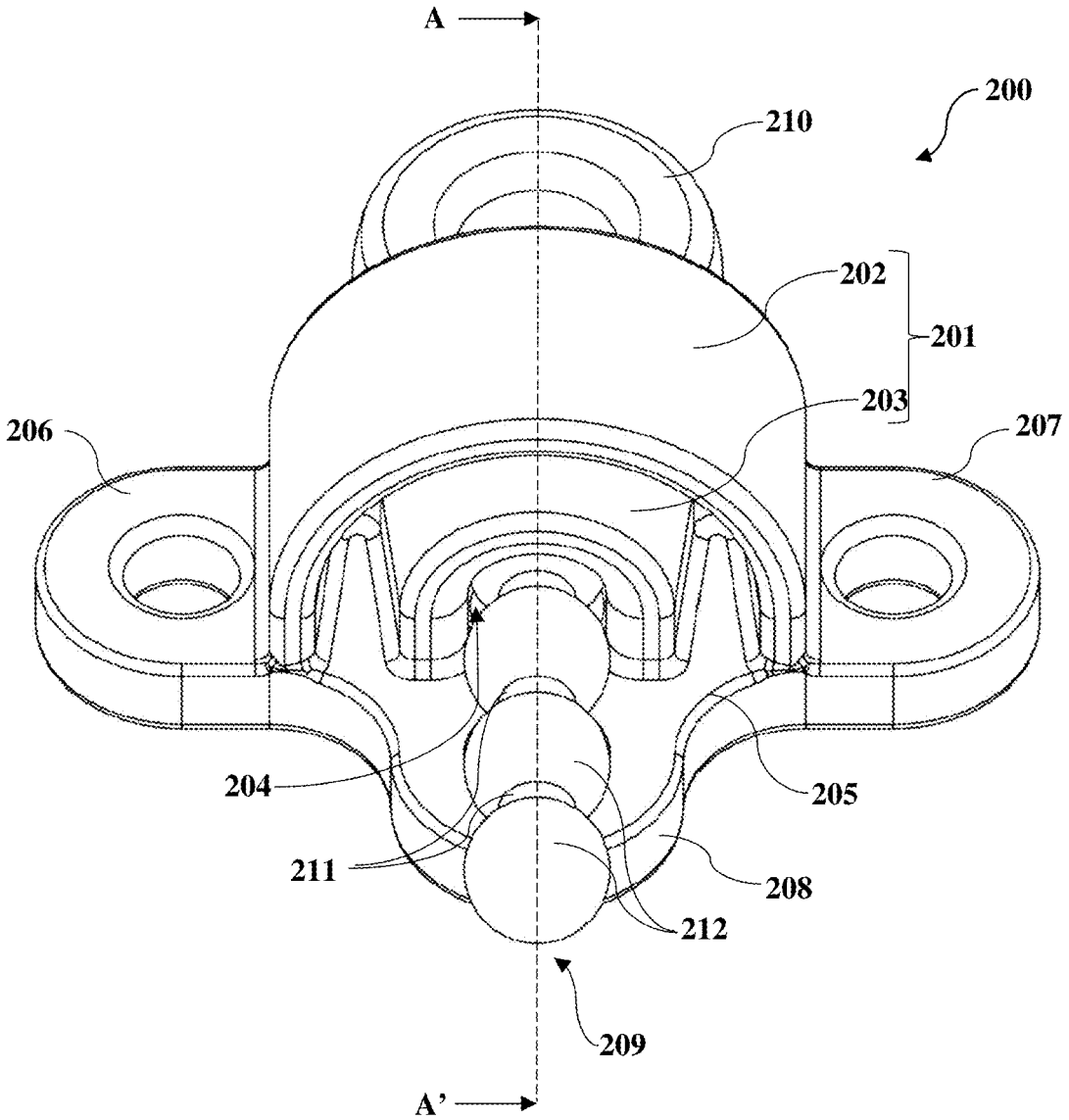
FIG. 4G exemplarily illustrates a bottom perspective view of the load sensitive connector shown in FIG. 4A, according to an embodiment herein.
Figure 4H:
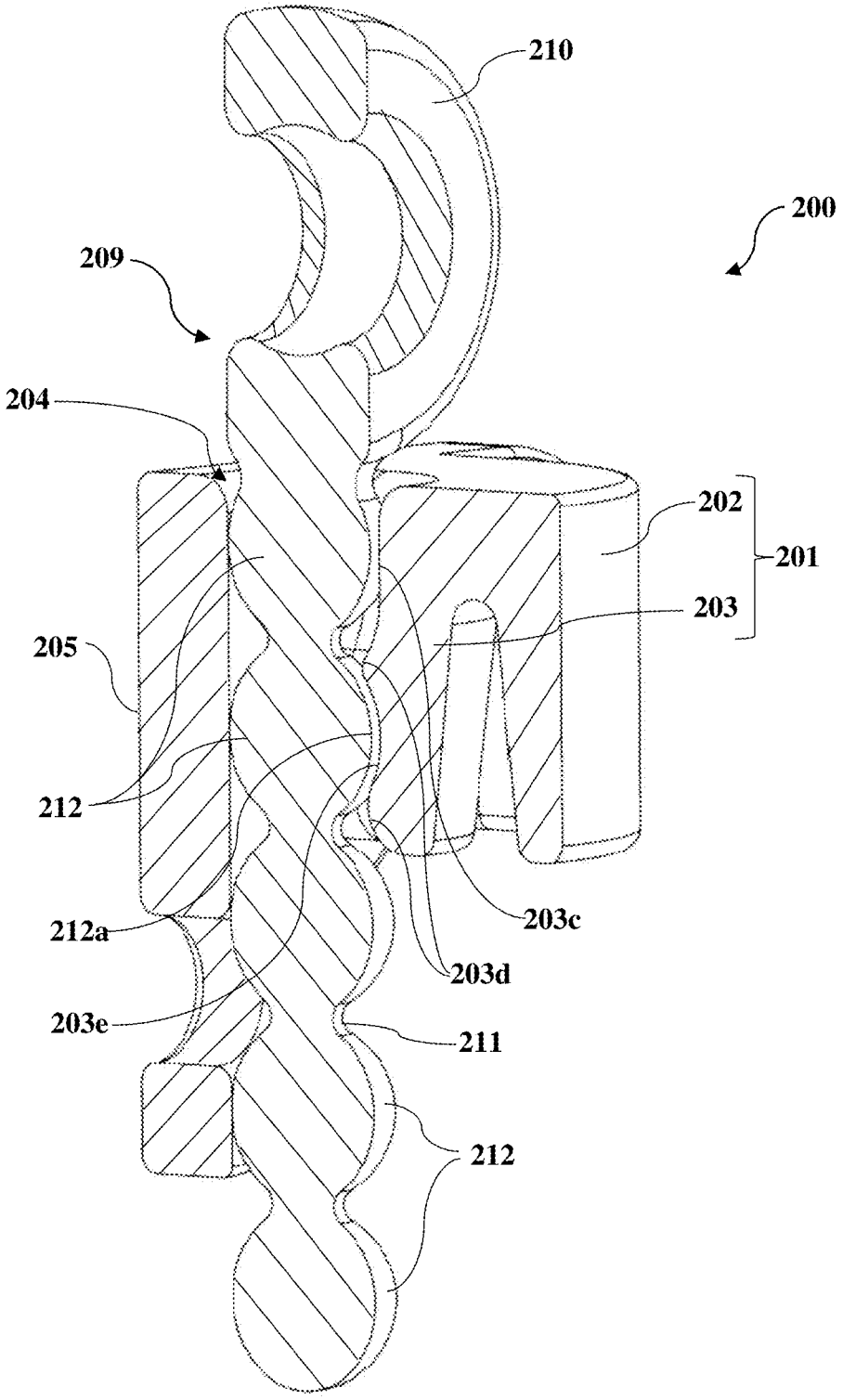
FIG. 4H exemplarily illustrates a sectional view of the load sensitive connector taken along section A-A' shown in FIG. 4G, according to an embodiment herein.

FIG. 4H exemplarily illustrates a sectional view of the load sensitive connector 200 taken along section A-A' shown in FIG. 4G, according to an embodiment herein. In an embodiment as exemplarily illustrated in FIG. 4H, the inner wall 203*c* of the inner bracket 203 of the bracket assembly 201 is curvedly shaped with molded indentations 203*d* to receive the sound generating elements 212 configured along the length of the elongate member 211 of the bolt assembly 209 and to engageably connect the elongate member 211 in the opening 204 of the inner bracket 203. In an embodiment, the sound generating elements 212 are of a spherical shape as exemplarily illustrated in FIG. 4H. In this embodiment, the inner wall 203*c* of the inner bracket 203 is configured with curved areas 203*e* defined between the molded indentations 203*d*. During engagement of the bolt assembly 209 with the bracket assembly 201, curved surfaces 212*a* of the spherical-shaped sound generating elements 212 are configured to sit firmly against the curved areas 203*e* between the molded indentations 203*d* of the inner bracket 203. On disengagement of the elongate member 211 from the opening 204 in the inner bracket 203 of the bracket assembly 201, the sound generating elements 212 generate a sound or a noise through friction of their curved surfaces 212*a* against the molded indentations 203*d* configured on the inner wall 203*c* of the inner bracket 203 to provide an audible warning to a user that the speed of the wind is beyond a predefined safe limit, when the speed of the wind exceeds the predefined wind speed of more than about 20 mph.

Figure 4I:
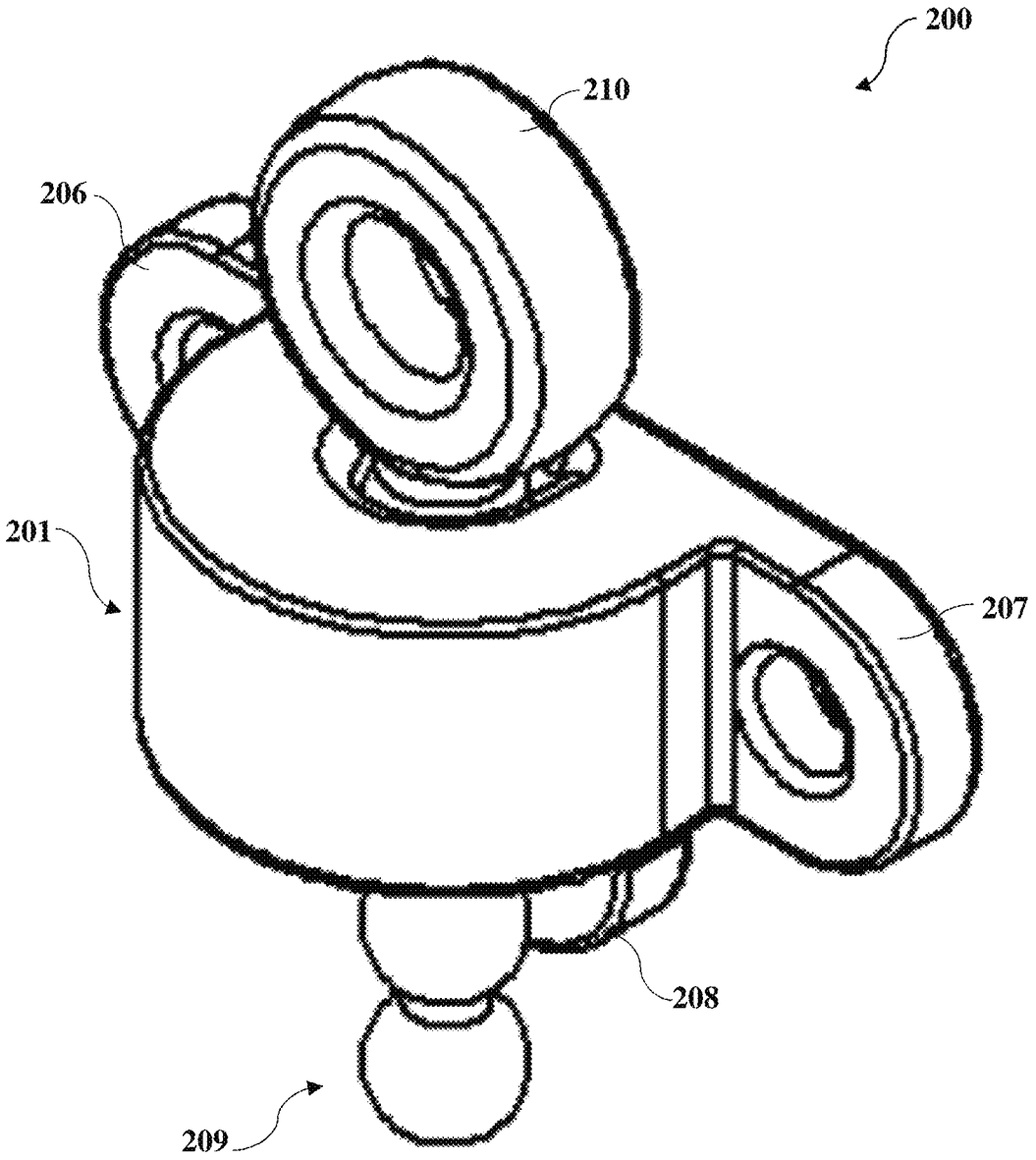
FIG. 4I exemplarily illustrates a perspective view of the load sensitive connector, showing a bolt assembly of the load sensitive connector attached to a bracket assembly of the load sensitive connector, according to an embodiment herein.

FIG. 4I exemplarily illustrates a perspective view of the load sensitive connector 200, showing the bolt assembly 209 of the load sensitive connector 200 attached to the bracket assembly 201 of the load sensitive connector 200, according to an embodiment herein. As exemplarily illustrated in FIG. 4I, the load sensitive connector 200 comprises mating connectors, that is, the bracket assembly 201 and the bolt assembly 209. In normal wind conditions, the bolt assembly 209 of the load sensitive connector 200 is attached to or engaged with the bracket assembly 201 of the load sensitive connector 200 as exemplarily illustrated in FIG. 4I.

Figure 4J:
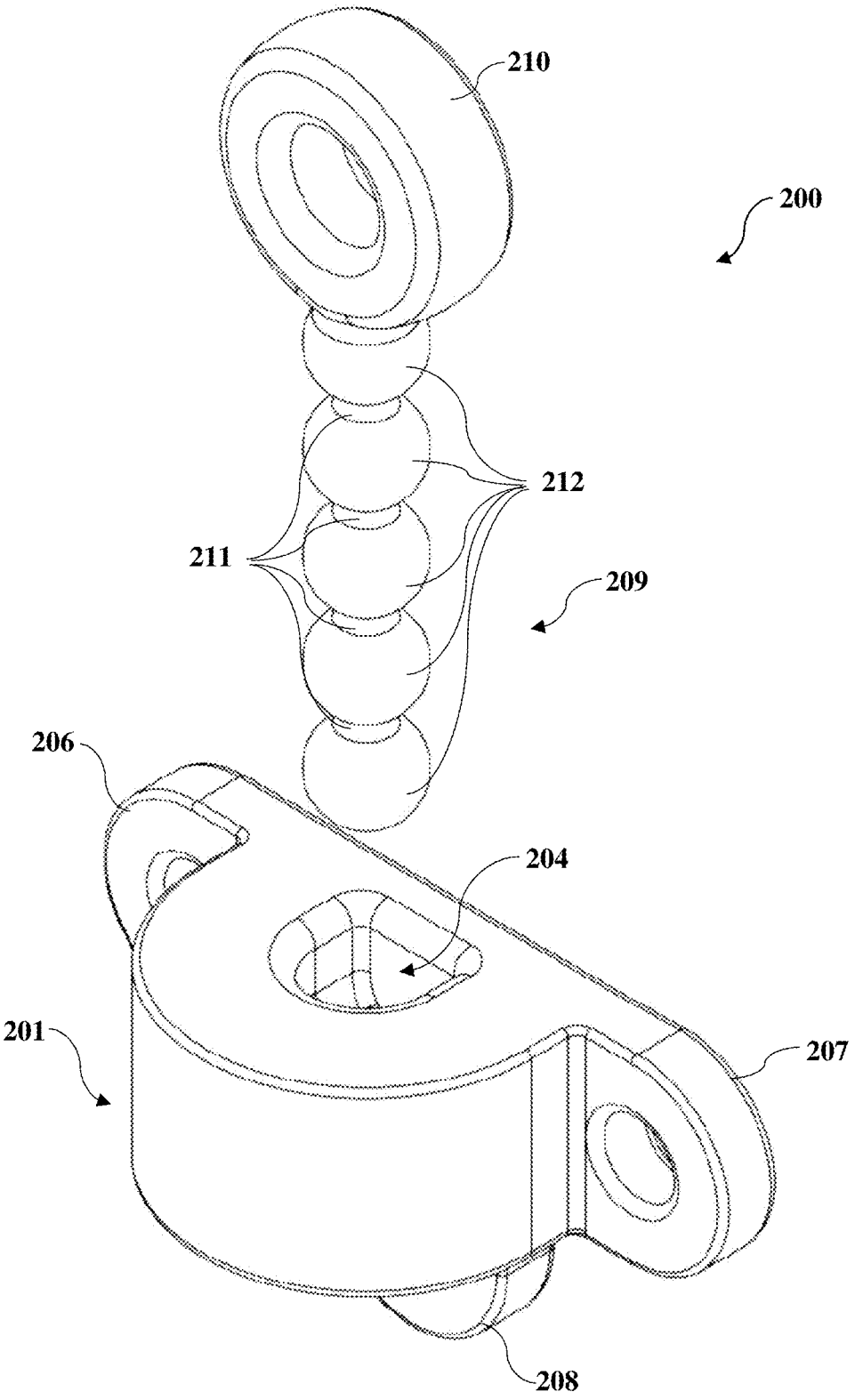
FIG. 4J exemplarily illustrates a perspective view of the load sensitive connector, showing the bolt assembly of the load sensitive connector detached from the bracket assembly of the load sensitive connector, according to an embodiment herein.

FIG. 4J exemplarily illustrates a perspective view of the load sensitive connector 200, showing the bolt assembly 209 of the load sensitive connector 200 detached from the bracket assembly 201 of the load sensitive connector 200, according to an embodiment herein. As exemplarily illustrated in FIG. 4J, the bracket assembly 201 is configured as a female connector, while the bolt assembly 209 is configured as a male connector. The opening 204 of the bracket assembly 201 is configured to receive the elongate member 211 of the bolt assembly 209, thereby allowing the bolt assembly 209 to be connected to the bracket assembly 201. When the speed of wind impacting the canopy 105 of the wind-resistant umbrella 100 exemplarily illustrated in FIGS. 2-3 and FIG. 5, exceeds a predefined wind speed of more than about 20 mph, the elongate member 211 of the bolt assembly 209 is configured to disengage from the opening 204 of the bracket assembly 201 as exemplarily illustrated in FIG. 4J, and generate a sound to provide an audible warning to a user that the speed of the wind is beyond a predefined safe limit as disclosed in the detailed description of FIG. 5. In an embodiment, the sound is generated by friction of the curved surfaces 212*a* of the sound generating elements 212 of the bolt assembly 209 against the molded indentations 203*d* configured on the inner wall 203*c* of the inner bracket 203 of the bracket assembly 201 as exemplarily illustrated in FIG. 4H.

Exemplarily dimensions of the components of the load sensitive connector 200 are as follows: The length of the outer bracket 202 of the bracket assembly 201 is, for example, about 0.243 inches. The length of the bracket assembly 201 including the flanges 206 and 207 is, for example, about 0.343 inches. The width of the bracket assembly 201 is, for example, about 0.148 inches. The height of the bracket assembly 201 is, for example, about 0.1 inches. The diameter of each of the openings 206*a*, 207*a*, and 208*a* of the flanges 206, 207, and 208 respectively is, for example, about 0.04 inches. The thickness of each of the flanges 206, 207, and 208 is, for example, about 0.031 inches. The height of the bolt assembly 209 is, for example, about 0.375 inches. The thickness of the head member 210 of the bolt assembly 209 is, for example, about 0.05 inches. The diameter of the head member 210 of the bolt assembly 209 is, for example, about 0.126 inches. The diameter of the opening 210*a* of the head member 210 is, for example, about 0.055 inches. The diameter of each of the sound generating elements 212 of the bolt assembly 209 is, for example, about 0.05 inches.

Figure 5:
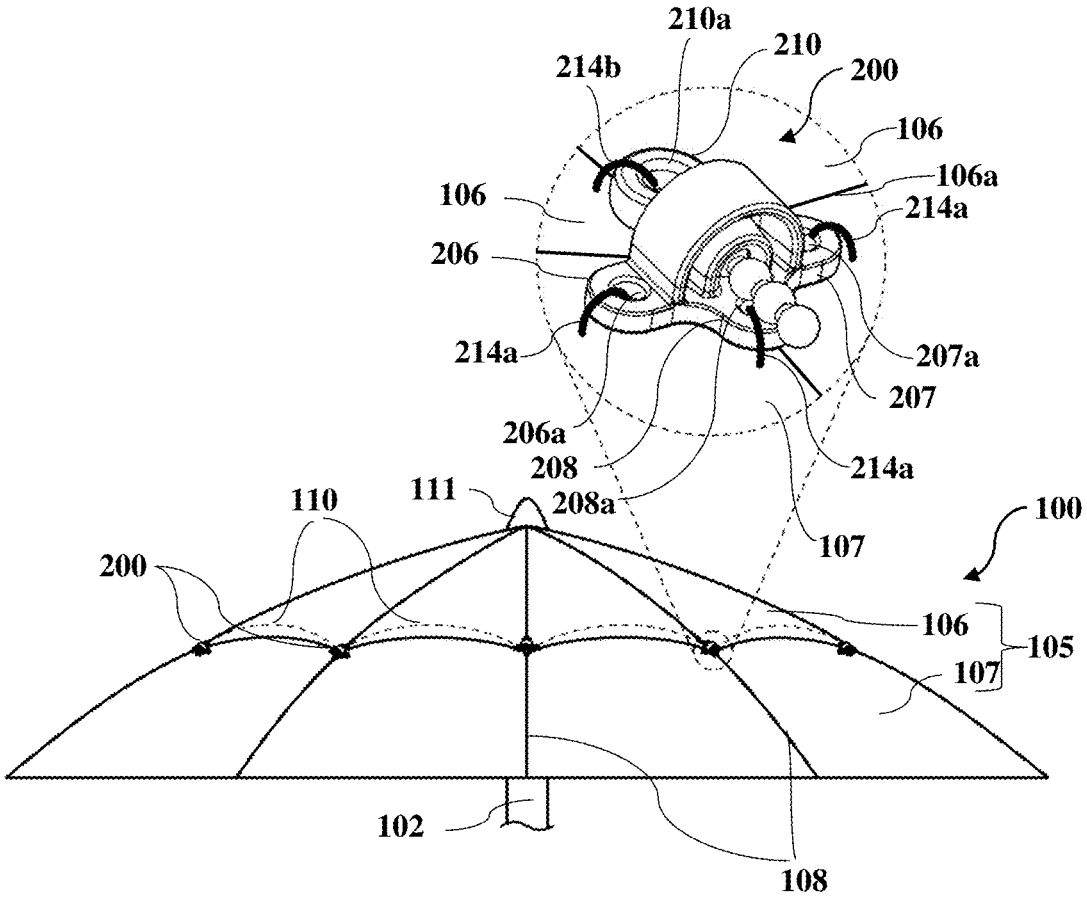
FIG. 5 exemplarily illustrates a front view of the canopy of the wind-resistant umbrella, showing an enlarged view of the load sensitive connector, according to an embodiment herein.

FIG. 5 exemplarily illustrates a front view of the canopy 105 of the wind-resistant umbrella 100, showing an enlarged view of the load sensitive connector 200, according to an embodiment herein. Multiple load sensitive connectors 200 are positioned on the flexible ribs 108 and attached at the lower peripheral edge 106*a* of the upper canopy section 106 and proximal to the upper peripheral edge 107*b* of the lower canopy section 107 of the canopy 105 exemplarily illustrated in FIGS. 7-8. The load sensitive connectors 200 constitute an audible connection assembly and detachably couple the upper canopy section 106 to the lower canopy section 107 of the canopy 105. The upper canopy section 106 partially overlaps the lower canopy section 107 along the load sensitive connectors 200. Each of the load sensitive connectors 200 comprises the bracket assembly 201 and the bolt assembly 209 as disclosed in the detailed descriptions of FIGS. 4A-4J. The bracket assembly 201 is configured to be attached to the lower canopy section 107 of the canopy 105. In an embodiment, the flanges 206, 207, and 208 of the bracket assembly 201 are configured to be attached to the lower canopy section 107 of the canopy 105. The flanges 206, 207, and 208 of the bracket assembly 201 are attached to the lower canopy section 107 of the canopy 105 using fastening elements, for example, ties 214*a*, inserted into the openings 206*a*, 207*a*, and 208*a* of the flanges 206, 207, and 208 respectively and fastened to the lower canopy section 107 of the canopy 105 as exemplarily illustrated in the enlarged view of the load sensitive connector 200 shown in FIG. 5. The head member 210 is configured to be attached to the upper canopy section 106 of the canopy 105. The head member 210 is attached to the upper canopy section 106 of the canopy 105 using a fastening element, for example, a tie 214*b*, inserted into the opening 210*a* of the head member 210 and fastened to the upper canopy section 106 of the canopy 105 as exemplarily illustrated in the enlarged view of the load sensitive connector 200 shown in FIG. 5. In an embodiment, the ties 214*a* and 214*b* are sewn into the lower canopy section 107 and the upper canopy section 106 of the canopy 105 respectively. In an embodiment (not shown), the positions of the mating connectors, that is, the bracket assembly 201 and the bolt assembly 209 are interchanged, such that the bracket assembly 201 is attached to the upper canopy section 106 of the canopy 105 and the bolt assembly 209 is attached to the lower canopy section 107 of the canopy 105.

Upon receiving a pulling force of, for example, about 17 Newtons to about 21 Newtons as generated by wind in excess of 20 mph, the bolt assembly 209 begins a rapid detachment from the bracket assembly 201. Ridges defined by the sound generating elements 212 along the elongate member 211 of the bolt assembly 209 contact the molded indentations 203*d* on the inner wall 203*c* of the inner bracket 203 of the bracket assembly 201 exemplarily illustrated in FIG. 4H, upon detachment, thereby generating a distinct sound. The sound generated is, for example, a clicking sound or a zipping sound. Moreover, the shape and structure of the load sensitive connector body, that is, the bracket assembly 201, is configured to amplify the sound. Furthermore, the vibration caused by the detachment of the bolt assembly 209 from the bracket assembly 201 is amplified in the space 202*e* defined by the inner wall 202*d* of the outer bracket 202 and the upper surface 205*a* of the base member 205 exemplarily illustrated in FIG. 4A. This amplified sound serves as an audible warning to the user that the upper canopy section 106 has detached from the lower canopy section 107 of the canopy 105 as a result of wind speeds nearing excess or in excess of safe limits. The load sensitive connector 200 exemplarily illustrated in FIGS. 4A-4J produces a noticeable and amplified sound.

Figure 6A:
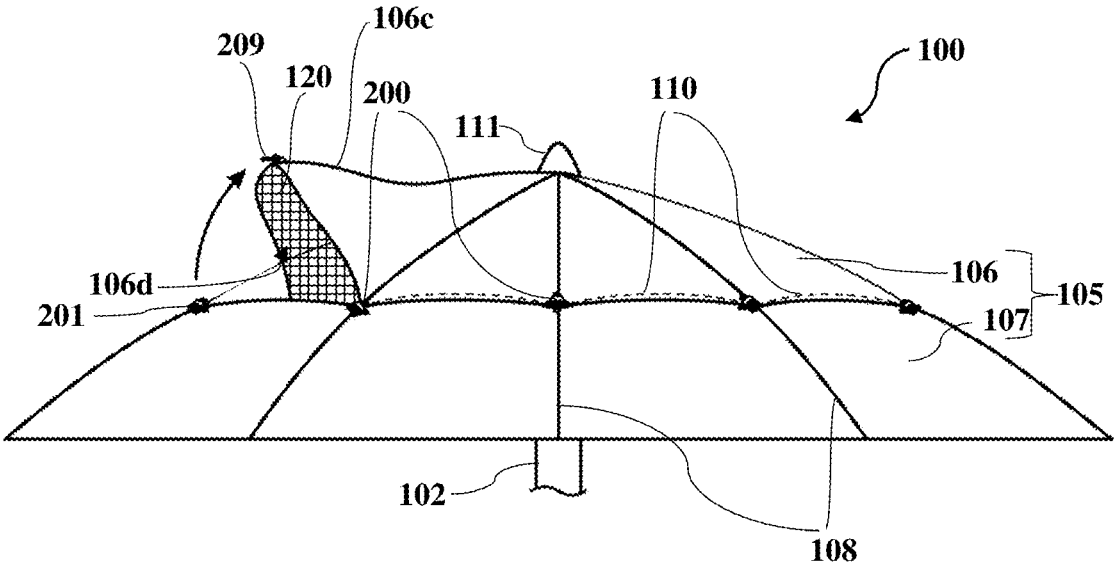
FIG. 6A exemplarily illustrates a front view of the canopy of the wind-resistant umbrella, showing separation of one panel of an upper canopy section from a lower canopy section of the canopy by detachment of one of the load sensitive connectors configured to detachably couple the upper canopy section to the lower canopy section, according to an embodiment herein.

FIG. 6A exemplarily illustrates a front view of the canopy 105 of the wind-resistant umbrella 100, showing separation of one panel 106*c* of the upper canopy section 106 from the lower canopy section 107 of the canopy 105 by detachment of one of the load sensitive connectors 200 configured to detachably couple the upper canopy section 106 to the lower canopy section 107 of the canopy 105, according to an embodiment herein. When speed of wind is beyond a predefined wind speed of more than about 20 mph, one or more of the load sensitive connectors 200 detach as a pulling strength of the speed of the wind exceeds the strength of attachment of the load sensitive connector(s) 200 between the upper canopy section 106 and the lower canopy section 107. In this embodiment, when the speed of the wind impacting the canopy 105 of the wind-resistant umbrella 100 exceeds the predefined wind speed of more than about 20 mph, the elongate member 211 of the bolt assembly 209 of at least one of the load sensitive connectors 200 is configured to disengage from the opening 204 in the inner bracket 203 of the bracket assembly 201 of the load sensitive connector 200 and generate a sound to provide an audible warning to a user that the speed of the wind is beyond a predefined safe limit. The head member 210 of the bolt assembly 209 attached to the upper canopy section 106 causes the elongate member 211 of the bolt assembly 209 to disengage from the opening 204 in the bracket assembly 201 attached to the lower canopy section 107 under an X amount of pulling force generated when wind speeds exceed the predefined wind speed of about 20 mph, where "X" is, for example, about 17 Newtons to about 21 Newtons. FIG. 6A exemplarily illustrates the bolt assembly 209 remaining attached to the panel 106*c* of the upper canopy section 106, while the bracket assembly 201 remains attached to the lower canopy section 107, after the load sensitive connector 200 detaches due to the X amount of pulling force generated to disengage the load sensitive connector 200 when wind speeds exceed the predefined wind speed.

In an embodiment, the sound generating elements 212 of the bolt assembly 209 generate a sound or a noise by friction of their curved surfaces 212*a* against the molded indentations 203*d* configured on the inner wall 203*c* of the inner bracket 203 of the bracket assembly 201 as exemplarily illustrated in FIG. 4H. The generated sound provides the audible warning to the user, when the speed of the wind exceeds the predefined wind speed of more than about 20 mph. The load sensitive connector 200 exemplarily illustrated in FIGS. 4A-4J, therefore, serves as an audible connector or an audible snap that detachably couples the upper canopy section 106 to the lower canopy section 107 of the canopy 105.

The detachment of at least one load sensitive connector 200, when the speed of the wind impacting the canopy 105 of the wind-resistant umbrella 100 exceeds the predefined wind speed, is characterized by the bolt assembly 209 attached to the upper canopy section 106 being disengaged from the bracket assembly 201 attached to the lower canopy section 107 as exemplarily illustrated in FIG. 6A. The detachment of the load sensitive connector 200 by the disengagement of the elongate member 211 of the bolt assembly 209 from the opening 204 in the inner bracket 203 of the bracket assembly 201 causes at least one panel 106*c* of the upper canopy section 106 to separate from the lower canopy section 107 as exemplarily illustrated in FIG. 6A, thereby decoupling the panel 106*c* of the upper canopy section 106 from the lower canopy section 107. The detachment of the load sensitive connector 200 also simultaneously generates a sound to provide the audible warning to the user. In an embodiment, high winds or high wind gusts cause the complete set of load sensitive connectors 200 to separate or detach, thereby decoupling the upper canopy section 106 from the lower canopy section 107.

In an embodiment, the wind-resistant umbrella 100 further comprises a highlighted pattern 120 configured on a lower surface 106*d* of the upper canopy section 106 of the canopy 105. The highlighted pattern 120 is, for example, a checked pattern, or a square pattern, or a coloration of a highlighted color such as a red color configured to provide a visual caution and alert the user that the speed of the wind is beyond a predefined safe limit. In cases where the user is unaware that the load sensitive connectors 200 have detached, which separated the upper canopy section 106 from the lower canopy section 107, the highlighted pattern 120 on the lower surface 106*d* of the upper canopy section 106 of the canopy 105 serves to display a visual caution to the user that the speed of the wind is beyond the predefined safe limit. In another embodiment, the lower surface 106*d* of the upper canopy section 106, near each of the load sensitive connectors 200, comprises a section or a wedge of fabric highlighted in a predefined pattern 120 or a coloration to display a caution to the user that the speed of the wind is beyond the predefined safe limit.

When the load sensitive connector 200 detaches, the highlighted pattern 120 is revealed for displaying a visual caution to the user that the speed of the wind is beyond the predefined safe limit. For example, detachment of the load sensitive connector 200 reveals the highlighted pattern 120 on the lower surface 106*d* of the panel 106*c* of the upper canopy section 106 as exemplarily illustrated in FIG. 6A, for displaying a visual caution to the user that the speed of the wind is beyond the predefined safe limit. In an embodiment, the detachment of the load sensitive connector 200 reveals a printed warning message on another lower surface 106*e* of the upper canopy section 106 exemplarily illustrated in FIG. 8, for displaying a visual caution to the user that the speed of the wind is beyond the predefined safe limit.

Figure 6B:
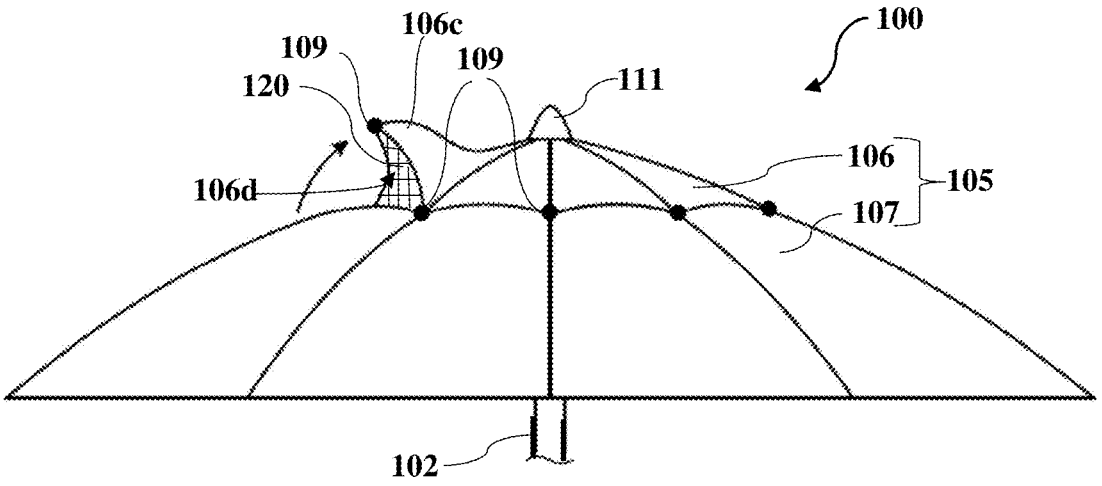
FIGS. 6B-6C exemplarily illustrate front views of the canopy of the wind-resistant umbrella, showing separation of one panel of the upper canopy section from the lower canopy section of the canopy by detachment of one of the load sensitive connectors configured to detachably couple the upper canopy section to the lower canopy section, according to another embodiment herein.
Figure 6C:
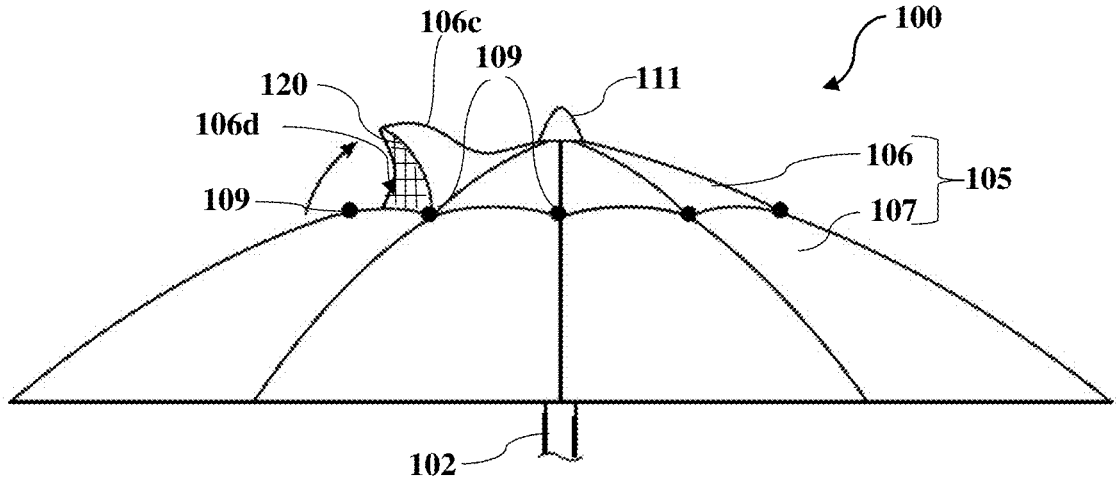

FIGS. 6B-6C exemplarily illustrate front views of the canopy 105 of the wind-resistant umbrella 100, showing separation of one panel 106*c* of the upper canopy section 106 from the lower canopy section 107 of the canopy 105 by detachment of one of the load sensitive connectors 109 configured to detachably couple the upper canopy section 106 to the lower canopy section 107 of the canopy 105, according to another embodiment herein. The load sensitive connectors 109 are fixedly attached to the upper canopy section 106 and between the upper canopy section 106 and the lower canopy section 107. High winds or high wind gusts cause one or more of the load sensitive connectors 109 or the complete set of load sensitive connectors 109 to separate or detach from the lower canopy section 107 while still remaining attached to the upper canopy section 106 as exemplarily illustrated in FIG. 6B. This separation of the load sensitive connector(s) 109 from the lower canopy section 107 causes the panel 106*c* or all of the upper canopy section 106 to detach from the lower canopy section 107, thereby opening a large void in the lower canopy section 107 for allowing a large volume of wind to flow through, thus preventing the wind-resistant umbrella 100 from being dislodged from an anchoring location, for example, sand on a beach, and being blown away, and simultaneously alerting the user of winds exceeding a safe limit. FIG. 6B exemplarily illustrates separation of one panel 106*c* of the upper canopy section 106 from the lower canopy section 107 by detachment of one load sensitive connector 109 from the lower canopy section 107 while the load sensitive connector 109 still remains attached to the upper canopy section 106. The separation of the load sensitive connectors 109 from the lower canopy section 107 serves as an early warning system, both audibly and visibly, to notify the user that wind speeds are in excess of safe umbrella usage and to prevent injury to persons on the beach.

In an embodiment as exemplarily illustrated in FIG. 6C, the load sensitive connectors 109 are fixedly attached to the lower canopy section 107 and between the upper canopy section 106 and the lower canopy section 107. High winds or high wind gusts cause one or more of the load sensitive connectors 109 or the complete set of load sensitive connectors 109 to separate from the upper canopy section 106 while still remaining attached to the lower canopy section 107 as exemplarily illustrated in FIG. 6C. This separation of the load sensitive connector(s) 109 from the upper canopy section 106 causes the panel 106*c* or all of the upper canopy section 106 to detach from the lower canopy section 107, thereby alerting a user of winds exceeding a safe limit and simultaneously opening a large void in the lower canopy section 107 for allowing a large volume of wind to flow through, thereby preventing the wind-resistant umbrella 100 from being dislodged from the anchoring location and being blown away. FIG. 6C exemplarily illustrates separation of one panel 106*c* of the upper canopy section 106 from the lower canopy section 107 by detachment of one load sensitive connector 109 from the upper canopy section 106 while the load sensitive connector 109 still remains attached to the lower canopy section 107.

FIG. 7 exemplarily illustrates a bottom perspective view of the wind-resistant umbrella 100, showing separation of one panel 106*c* of the upper canopy section 106 from the lower canopy section 107 of the canopy 105 by detachment of one of the load sensitive connectors 200 and a highlighted pattern 120 configured to display a visual caution to a user, according to an embodiment herein. The bottom perspective view in FIG. 7 shows the canopy 105 in a fully expanded position. A user opens the canopy 105 by sliding the runner 114 on the upper pole section 102 of the pole member 101 in an upward direction till the runner 114 locks onto the spring element (not shown) configured at a predetermined distance from the upper end 101*a* of the pole member 101. The stretchers 116 extending from the upper end 114*a* of the runner 114 and hingedly connected to the flexible ribs 108 stretch the canopy 105 to the fully expanded position as exemplarily illustrated in FIG. 7. FIG. 7 also exemplarily illustrates detachment of one of the load sensitive connectors 200, which separates one panel 106*c* of the upper canopy section 106 and reveals the highlighted pattern 120 on the lower surface 106*d* of the panel 106*c* of the upper canopy section 106 for displaying a visual caution to the user that the speed of the wind impacting the canopy 105 of the wind-resistant umbrella 100 is beyond a predefined safe limit.

FIG. 8 exemplarily illustrates a bottom perspective view of the wind-resistant umbrella 100, showing separation of one panel 106*c* of the upper canopy section 106 from the lower canopy section 107 of the canopy 105 by detachment of one of the load sensitive connectors 200 and highlighted flags 121*a* and 121*b* configured to display a visual caution to a user, according to an embodiment herein. In this embodiment, the wind-resistant umbrella 100 further comprises a highlighted flag 121*a* or 121*b* attached to at least one of the load sensitive connectors 200, on the lower surface 106*d* or 106*e* of the upper canopy section 106 of the canopy 105. The highlighted flags 121*a* and 121*b* are, for example, small fabric flags fixedly attached between the lower surfaces 106*d* and 106*e* of the upper canopy section 106 and the load sensitive connector 200 to display a visual caution to the user that the speed of the wind impacting the canopy 105 of the wind-resistant umbrella 100 is beyond a predefined safe limit. The highlighted flags 121*a* and 121*b* are made from fabrics comprising, for example, polyester, canvas, acrylic, polyvinyl chloride (PVC), nylon, polyester-nylon blend, marine-grade vinyl, silk, rayon, etc. As exemplarily illustrated in FIG. 8, two highlighted flags 121*a* and 121*b* are attached to two load sensitive connectors 200, on the lower surfaces 106*d* and 106*e* of the upper canopy section 106 of the canopy 105. In an embodiment, the highlighted flags 121*a* and 121*b* comprise, for example, a highlighted hatch pattern, a checked pattern, or a square pattern. In another embodiment, the highlighted flags 121*a* and 121*b* are of a highlighted color, for example, a red color configured to provide a visual caution and alert the user that the speed of the wind is beyond a predefined safe limit. When the load sensitive connector 200 detaches, the highlighted flag 121*a* is revealed for displaying a visual caution to the user that the speed of the wind impacting the canopy 105 of the wind-resistant umbrella 100 is beyond a predefined safe limit. FIG. 8 exemplarily illustrates detachment of one of the load sensitive connectors 200, which separates one panel 106*c* of the upper canopy section 106 and reveals the highlighted pattern 120 on the lower surface 106*d* of the panel 106*c* of the upper canopy section 106 for displaying a visual caution to the user that the speed of the wind impacting the canopy 105 of the wind-resistant umbrella 100 is beyond a predefined safe limit. The detachment of the load sensitive connector 200, which separates one panel 106*c* of the upper canopy section 106, also reveals the highlighted flag 121*a* connected to the bolt assembly 209 of the load sensitive connector 200 as exemplarily illustrated in FIG. 8.

FIGS. 9A-9D exemplarily illustrate different views of a supplementary connector 900 configured to generate sounds for providing an audible warning to a user, according to an embodiment herein. The supplementary connector 900 is, for example, a finial connector. A top perspective view of the supplementary connector 900 is exemplarily illustrated in FIG. 9A. In an embodiment as exemplarily illustrated in FIGS. 9A-9D, the supplementary connector 900 comprises an air chamber 901, an airflow inlet member 902, and a connecting member 904. The air chamber 901 is a hollow chamber configured to allow airflow therethrough. The airflow inlet member 902 is positioned on an upper end 901*a* of the air chamber 901. The airflow inlet member 902 comprises an air intake opening or hole 903 in fluid communication with the hollow air chamber 901. The connecting member 904 is positioned at a lower end 901*b* of the air chamber 901. The supplementary connector 900 further comprises multiple slots 905 and protruding elements 906. Each slot 905 and protruding element 906 together create a slotted hole or a narrow opening 907, also referred to as a whistle opening. The slots 905 are positioned around a lower perimeter or periphery 901*c* of the air chamber 901. The protruding elements 906 extend outwardly from inside the slots 905 to create narrow openings 907 through which air or the wind passes. A front elevation view of the supplementary connector 900 is exemplarily illustrated in FIG. 9B, where the rear elevation view is a mirror image thereof. The supplementary connector 900 is configured to generate sounds, for example, whistle sounds, for providing an audible warning to a user that the speed of the wind is beyond a predefined safe limit. The air intake opening 903 of the airflow inlet member 902 allows wind in excess of safe speeds to pass through the hollow air chamber 901 and out through the narrow openings 907 created by the protruding elements 906 in the slots 905 as exemplarily indicated by arrows in FIG. 9A, to create a whistle that provides an audible warning to the user that the speed of the wind is beyond a predefined safe limit. The whistle makes a louder sound with faster wind. The wind in excess of safe speeds enters the hollow air chamber 901 via the air intake opening 903 of the airflow inlet member 902, thereby forcing air into the air chamber 901. The air molecules from the wind pile up, create a high pressure region near the slots 905 in the air chamber 901, and escape through the narrow openings 907 created by the protruding elements 906 in the slots 905, thereby generating the whistling sound. The slots 905 with the protruding elements 906 divide the air and create oscillating sound waves in the air chamber 901. The compressed air escaping through the narrow openings 907 created by the protruding elements 906 in the slots 905 creates an audible whistling sound. The tone and pitch of the whistling sound depends on the configuration and the size of the slots 905 and the protruding elements 906 that create the narrow openings 907 through which the air escapes.

Figure 9A:
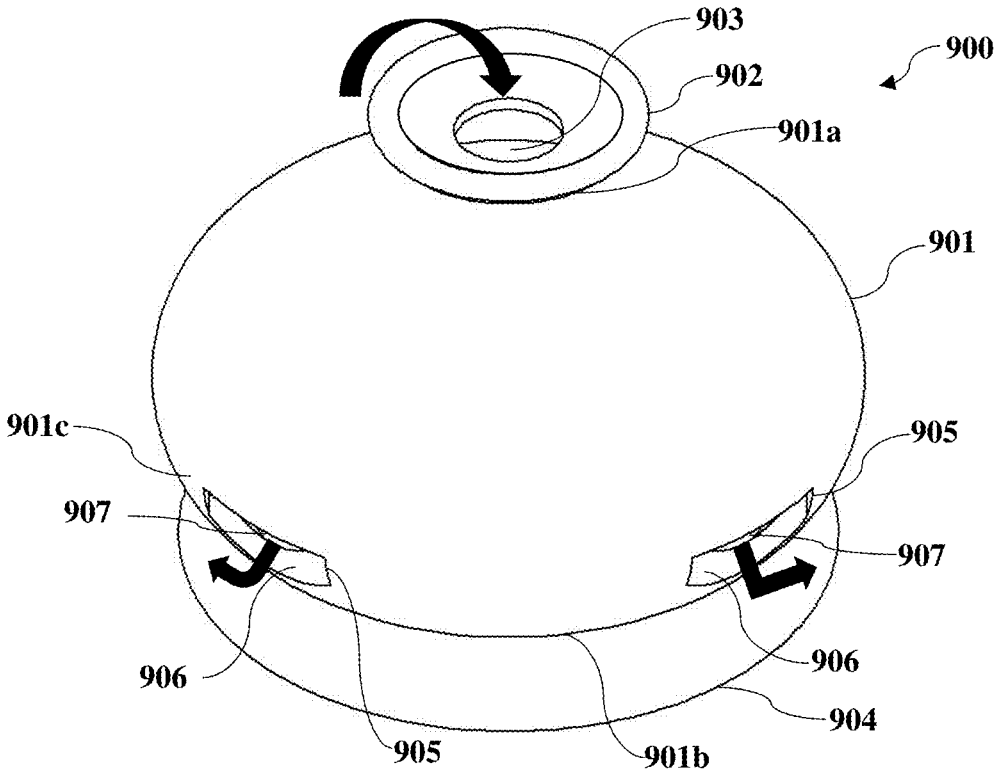
FIG. 9A exemplarily illustrates a top perspective view of a supplementary connector configured to generate sounds for providing an audible warning to a user, according to an embodiment herein.
Figure 9B:
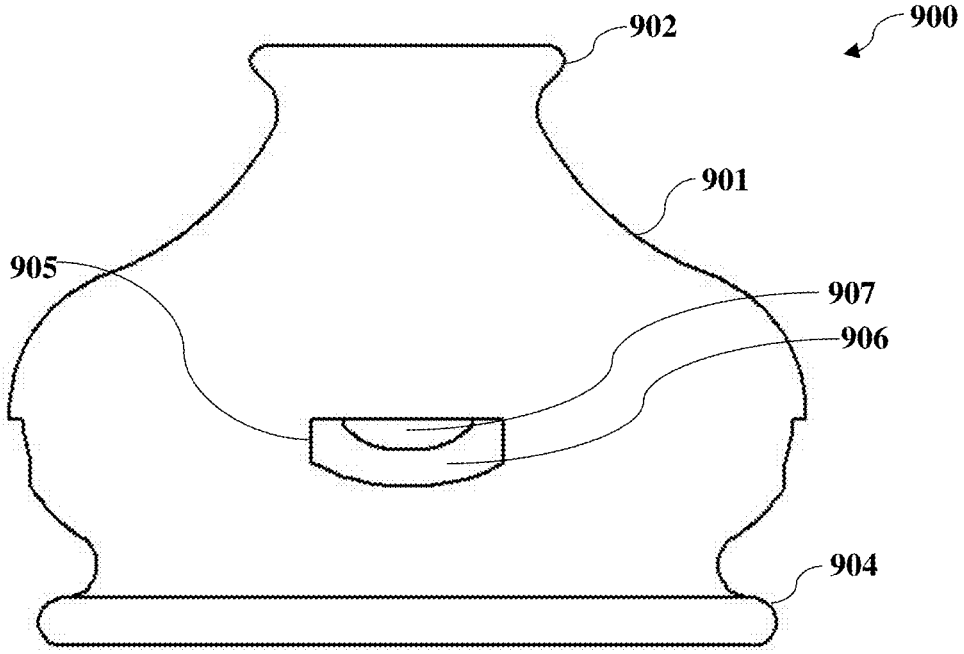
FIG. 9B exemplarily illustrates a front elevation view of the supplementary connector shown in FIG. 9A.
Figure 9C:
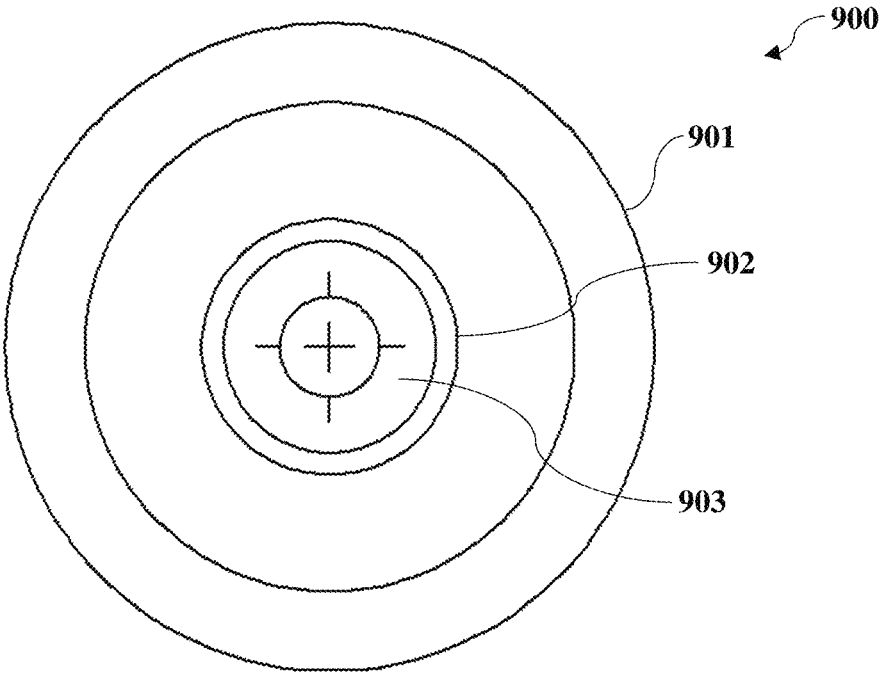
FIG. 9C exemplarily illustrates a top plan view of the supplementary connector shown in FIG. 9A.
Figure 9D:
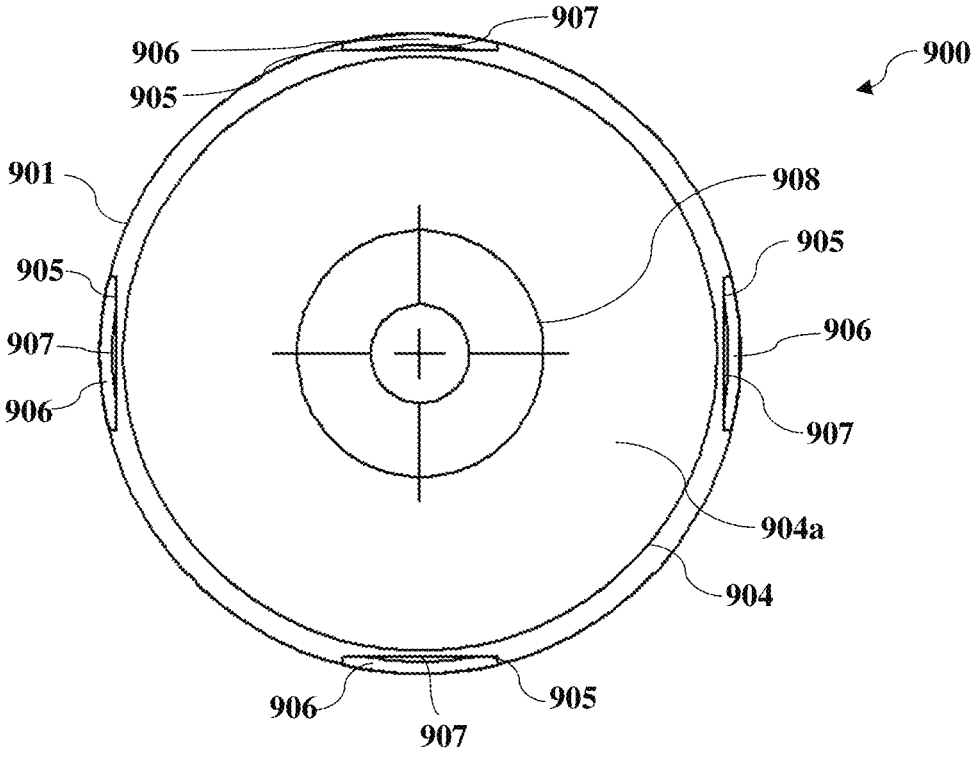
FIG. 9D exemplarily illustrates a bottom view of the supplementary connector shown in FIG. 9A.

A top plan view and a bottom view of the supplementary connector 900 are exemplarily illustrated in FIGS. 9C-9D respectively. The top plan view in FIG. 9C exemplarily illustrates the air intake opening 903 of the airflow inlet member 902 through which air of the wind enters the hollow air chamber 901. An outer diameter of the air chamber 901 is, for example, about 2.6 inches. The bottom view in FIG. 9D exemplarily illustrates a bottom end 904*a* of the connecting member 904. The diameter of the connecting member 904 is, for example, about 2.4 inches. As exemplarily illustrated in FIG. 9D, the bottom end 904*a* of the connecting member 904 comprises a threaded hole 908 configured to threadably engage with the upper end 101*a* of the pole member 101 of the wind-resistant umbrella 100 exemplarily illustrated in FIGS. 1B-1C and FIGS. 7-8, to connect the supplementary connector 900 to the pole member 101 of the wind-resistant umbrella 100. The diameter of the threaded hole 908 is, for example, about 1 inch. The bottom view in FIG. 9D also exemplarily illustrates the slots 905 with the protruding elements 906 on diametrically opposite ends of the hollow air chamber 901. The length of each of the slots 905 is, for example, about 0.625 inches. The supplementary connector 900 is configured to whistle when the speed of the wind exceeds the predefined wind speed of about 20 mph. Wind passes along the top of the airflow inlet member 902 and enters into the air intake opening 903 of the airflow inlet member 902. As wind speed increases, the air volume and speed increases which forces air out the narrow openings 907 created by the protruding elements 906 in the slots 905, thereby creating a sound. At lower wind speeds, a mostly inaudible sound is generated, which becomes increasingly noticeable at higher wind speeds.

Figure 10:
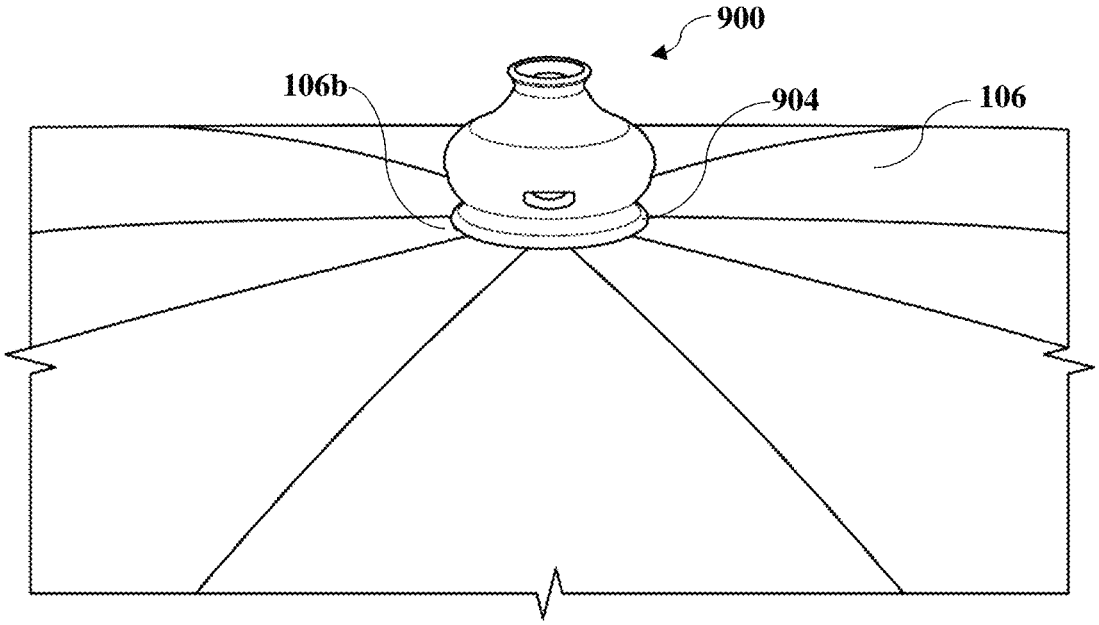
FIG. 10 exemplarily illustrates a partial perspective view, showing the supplementary connector installed at a center of the upper canopy section of the canopy, according to an embodiment herein.

FIG. 10 exemplarily illustrates a partial perspective view, showing the supplementary connector 900 installed at the center 106*b* of the upper canopy section 106 of the canopy 105, according to an embodiment herein. In this embodiment, the supplementary connector 900 is disposed at the center 106*b* of the upper canopy section 106 of the canopy 105 and fixed to the upper end 101*a* of the pole member 101 of the wind-resistant umbrella 100 exemplarily illustrated in FIGS. 1B-1C and FIGS. 7-8. The threaded hole 908 of the connecting member 904 exemplarily illustrated in FIG. 9D, is configured to threadably engage the supplementary connector 900 with the upper end 101*a* of the pole member 101 of the wind-resistant umbrella 100 exemplarily illustrated in FIGS. 1B-1C and FIGS. 7-8. The supplementary connector 900 is, therefore, semi-permanently fixed to the center 106*b* of the upper canopy section 106 of the canopy 105 as exemplarily illustrated in FIG. 10. The supplementary connector 900 holds the canopy 105 over the pole member 101 and is configured to generate a whistling sound on receiving a wind of speed exceeding the predefined wind speed of more than about 20 mph for providing an audible warning to a user that the speed of the wind is beyond a predefined safe limit as disclosed in the detailed description of FIGS. 9A-9D.

Figure 11:
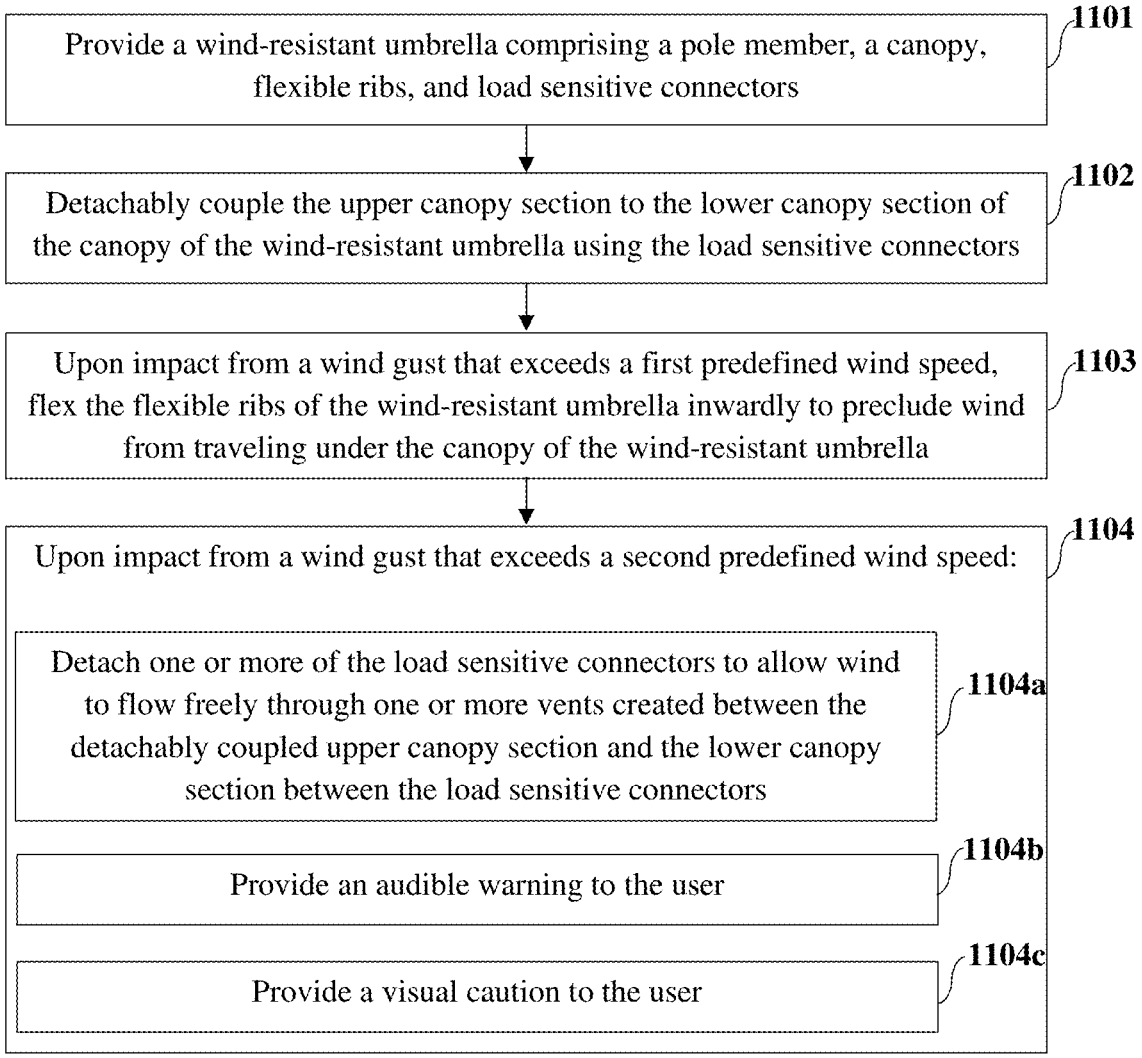
FIG. 11 illustrates a flowchart of a method for precluding dislodgment of the wind-resistant umbrella from an anchoring location and simultaneously providing one or more warnings to a user, according to an embodiment herein.

FIG. 11 illustrates a flowchart of a method for precluding dislodgment of the wind-resistant umbrella 100 from an anchoring location and simultaneously providing one or more warnings, for example, audible and/or visual warnings, to a user, according to an embodiment herein. In the method disclosed herein, the wind-resistant umbrella 100 comprising the pole member 101, the canopy 105, the flexible ribs 108, and the load sensitive connectors 109 or 200 exemplarily illustrated in FIGS. 1A-10 and as disclosed in the detailed descriptions of FIGS. 1A-10, is provided 1101. The upper canopy section 106 is detachably coupled 1102 to the lower canopy section 107 of the canopy 105 of the wind-resistant umbrella 100 using the load sensitive connectors 109 or 200.

Upon impact from a wind gust that exceeds a predefined wind speed of more than about 10 mph, the flexible ribs 108 of the wind-resistant umbrella 100 flex 1103 inwardly to preclude wind from traveling under the canopy 105 of the wind-resistant umbrella 100. Upon impact from a wind gust that exceeds a predefined wind speed of more than about 20 mph 1104, one or more of the load sensitive connectors 109 or 200 detach 1104*a* to allow wind to flow freely through one or more vents 110 created between the detachably coupled upper canopy section 106 and the lower canopy section 107 between the load sensitive connectors 109 or 200, while generating a sound to provide an audible warning 1104*b* to the user, and to preclude tilting and lifting actions caused by the wind on the wind-resistant umbrella 100, thereby precluding dislodgment of the wind-resistant umbrella 100 from the anchoring location, for example, sand on a beach or a ground.

The flexible ribs 108 flex inwardly to reduce the amount of airflow under the lower canopy section 107 of the canopy 105. When volume of the airflow exceeds the amount of airflow that the flexible ribs 108 can buffer, then one or more of the load sensitive connectors 109 or 200 detach to allow wind to flow freely through one or more vents 110 created between the detachably coupled upper canopy section 106 and the lower canopy section 107 between the load sensitive connectors 109 or 200. The load sensitive connectors 109 or 200 detach, when the speed of the wind is beyond the predefined wind speed of about 20 mph, as a pulling strength of the speed of the wind exceeds the strength of attachment of the load sensitive connectors 109 or 200 between the upper canopy section 106 and the lower canopy section 107. The load sensitive connectors 109 or 200 make a sound upon detaching to provide an audible warning that the speed of the wind is beyond a predefined safe limit.

In an embodiment, a visual caution is provided 1104*c* to the user that the speed of the wind is beyond a predefined safe limit using at least one of: the highlighted pattern 120 configured on the lower surface 106*d* of the upper canopy section 106 of the canopy 105 exemplarily illustrated in FIGS. 6A-6C and FIGS. 7-8; and the highlighted flag 121*a* or 121*b* attached to at least one of the load sensitive connectors 200 on the lower surface 106*d* or 106*e* of the upper canopy section 106 of the canopy 105 as exemplarily illustrated in FIG. 8. In an embodiment, the load sensitive connectors 109 or 200 have a nondescript color when viewed from the top of the upper canopy section 106 and a highlight color on the lower surface 106*d* of the upper canopy section 106 that becomes visible when the load sensitive connectors 109 or 200 detach, which serves as a visual caution to a user that the speed of the wind is beyond a predefined safe limit. In another embodiment, the load sensitive connectors 109 or 200 have a highlight colored flag 121*a* or 121*b* attached on the lower surface 106*d* or 106*e* of the upper canopy section 106 that becomes visible when the load sensitive connectors 109 or 200 detach, which serves as a visual caution to a user that the speed of the wind is beyond a predefined safe limit.

Figure 12C:
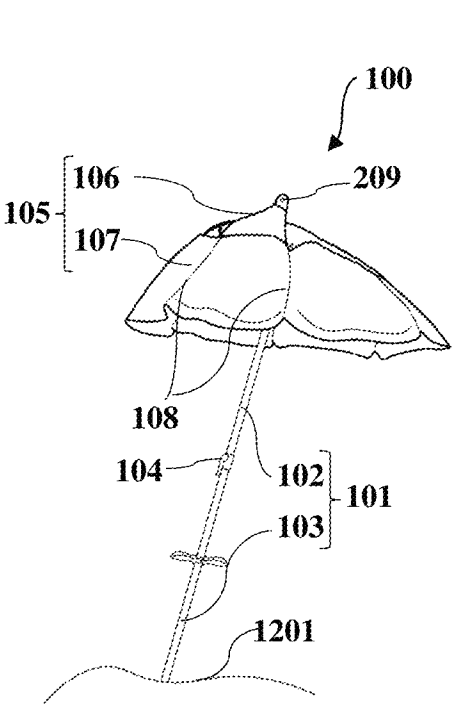
FIGS. 12A-12C illustrate schematics showing operation of the wind-resistant umbrella upon impact from a wind gust that exceeds a predefined wind speed, according to an embodiment herein.
Figure 12B:
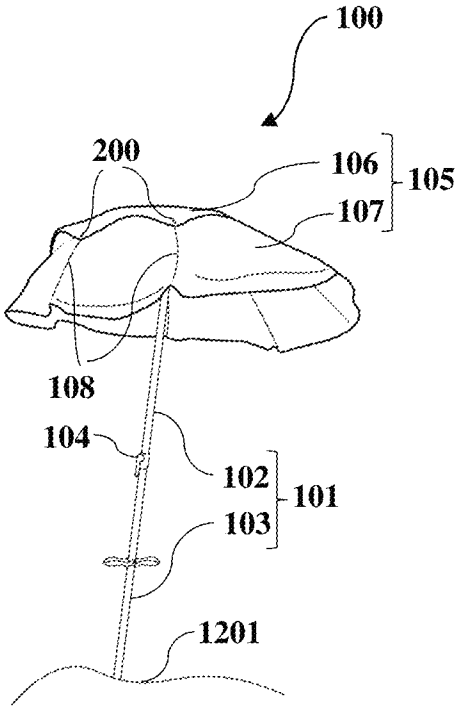
Figure 12A:
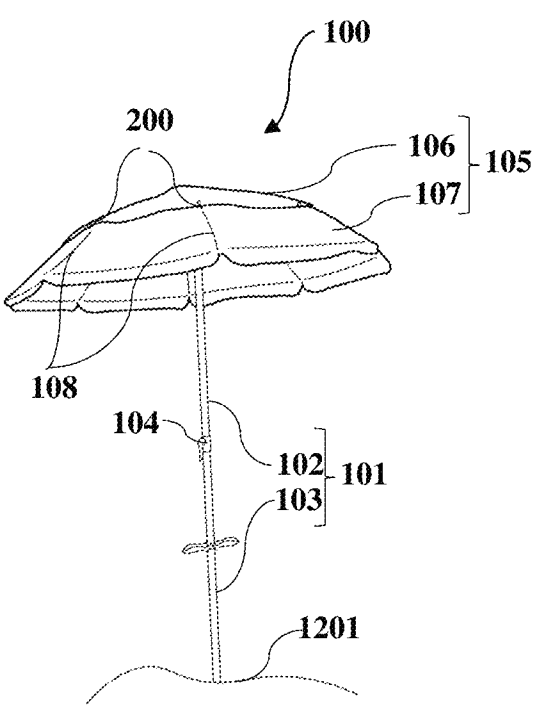

FIGS. 12A-12C illustrate schematics showing operation of the wind-resistant umbrella 100 upon impact from a wind gust that exceeds a predefined wind speed, according to an embodiment herein. Consider an example where a user of the wind-resistant umbrella 100 at a beach initiates installation of the wind-resistant umbrella 100 in an anchoring location, for example, sand 1201 on the beach. To install the wind-resistant umbrella 100, the user first inserts the tip 103*b* of the lower pole section 103 of the pole member 101 exemplarily illustrated in FIGS. 1A-2 and FIGS. 7-8, into the sand 1201 and screws the anchoring element 112 fixed at the anchoring portion 103*c* of the lower pole section 103 into the sand 1201, such that the lower pole section 103 is buried to a correct depth indicated by the depth indicator 113, for example, a line configured on the lower pole section 103, in the sand 1201. Once the lower pole section 103 is installed, the user connects the upper pole section 102 of the pole member 101 that holds the canopy 105 to the lower pole section 103 using the securing assembly 104. The user then couples the upper canopy section 106 to the lower canopy section 107 to form the canopy 105 using the load sensitive connectors 109 or 200 exemplarily illustrated in FIGS. 1A-2 and FIGS. 7-8. The user then opens the canopy 105 of the wind-resistant umbrella 100 into the fully expanded position using the runner 114 connected to the stretchers 116 that are operably coupled to the flexible ribs 108 on the canopy 105 as exemplarily illustrated in FIGS. 1B-1D and FIGS. 7-8. The installed wind-resistant umbrella 100 is exemplarily illustrated in FIG. 12A.

Low to medium winds or wind gusts cause one or more of the flexible ribs 108 to flex or bend inwardly to prevent wind from traveling under the canopy 105 of the wind-resistant umbrella 100 as exemplarily illustrated in FIG. 12B. For example, when a wind with a speed of more than about 10 mph impacts the canopy 105 of the wind-resistant umbrella 100, the flexible ribs 108 flex inwardly to preclude the wind from traveling under the canopy 105. As wind speeds increase, high winds or high wind gusts cause one or more of the load sensitive connectors 200 or the complete set of load sensitive connectors 200 to separate the upper canopy section 106 from the lower canopy section 107 of the canopy 105. For example, upon impact from a wind gust that exceeds a predefined wind speed of about 20 mph, one of the load sensitive connectors 200 detach as exemplarily illustrated in FIG. 12C, to allow the wind to flow freely through one or more vents 110 created between the detachably coupled upper canopy section 106 and the lower canopy section 107, between the load sensitive connectors 200 exemplarily illustrated in FIGS. 2-3, while generating a sound to provide an audible warning to the user, and to preclude tilting and lifting actions caused by the wind on the wind-resistant umbrella 100, thereby precluding dislodgment of the wind-resistant umbrella 100 from the sand 1201. The upper canopy section 106 decouples at the area facing into the wind and allows wind gusts, for example, beyond 20 mph to safely escape through the canopy 105 without surpassing a tilt threshold of, for example, about 15 degrees. Moreover, the inwardly flexed, flexible ribs 108 cause the canopy 105 to resist wind from flowing under the canopy 105 for prolonging the release of the detachable coupling between the upper canopy section 106 and the lower canopy section 107 of the canopy 105. Furthermore, the inwardly flexed, flexible ribs 108 resists the creation of a lift on an underside of the canopy 105 of the wind-resistant umbrella 100.

The pole member 101 of the wind-resistant umbrella 100 is securely anchored at a predetermined depth identified by the depth indicator 113 into the sand 1201, thereby firmly interfacing with the sand 1201 and precluding dislodgement of the wind-resistant umbrella 100 from the sand 1201. The depth indicator 113 indicates to the user the correct depth for inserting the pole member 101 into the sand 1201, thereby not requiring the user to have specific knowledge and skill for proper insertion of the pole member 101 into the sand 1201. The secure anchoring of the pole member 101 precludes wind forces from tilting the wind-resistant umbrella 100 to a degree that allows wind gusts to create a lift on the underside of the canopy 105 of the wind-resistant umbrella 100, thereby precluding dislodgement of the wind-resistant umbrella 100 from the sand 1201. For example, the wind-resistant umbrella 100 tilts to only about 12 degrees as exemplarily illustrated in FIG. 12C, after about 10 minutes of 30 mph wind speeds. By precluding dislodgement of the wind-resistant umbrella 100 from the sand 1201, upon impact from winds having a high speed of more than about 20 mph, the wind-resistant umbrella 100 is not carried by the high-speed winds and blown away across a beach, thereby preventing possible injuries and fatalities at the beach. The wind-resistant umbrella 100 is configured to meet beach safety commission requirements. The wind-resistant umbrella 100 provides audible and visual warnings to users when wind speeds are unsafe.

The foregoing examples and illustrative implementations of various embodiments have been provided merely for explanation and are in no way to be construed as limiting of the wind-resistant umbrella 100 disclosed herein. Dimensions of various parts of the wind-resistant umbrella 100 disclosed above are exemplary, and are not limiting of the scope of the embodiments herein. While the wind-resistant umbrella 100 has been described with reference to various embodiments, illustrative implementations, drawings, and techniques, it is understood that the words, which have been used herein, are words of description and illustration, rather than words of limitation. Furthermore, although the wind-resistant umbrella 100 has been described herein with reference to particular means, materials, techniques, implementations, and embodiments, the wind-resistant umbrella 100 is not intended to be limited to the particulars disclosed herein; rather, the wind-resistant umbrella 100 extends to all functionally equivalent structures, methods, and uses, such as are within the scope of the appended claims. While multiple embodiments are disclosed, it will be understood by those skilled in the art, having the benefit of the teachings of this specification, that the wind-resistant umbrella 100 disclosed herein is capable of modifications and other embodiments may be effected and changes may be made thereto, without departing from the scope and spirit of the wind-resistant umbrella 100 disclosed herein.

We claim:

1. A wind-resistant umbrella comprising:

a pole member;

a canopy attached to an upper end of the pole member, wherein the canopy comprises an upper canopy section and a lower canopy section, and wherein the upper canopy section is detachably coupled to the lower canopy section, and wherein a surface area of the detachably coupled upper canopy section is of a predefined size with respect to a surface area of the lower canopy section;

a plurality of flexible ribs extending radially from the upper end of the pole member towards a lower peripheral edge of the lower canopy section of the canopy, wherein the flexible ribs are configured to support the upper canopy section and the lower canopy section of the canopy and flex inwardly at a first predefined wind speed;

a plurality of load sensitive connectors positioned on the flexible ribs and attached at a lower peripheral edge of the upper canopy section and proximal to an upper peripheral edge of the lower canopy section, wherein the load sensitive connectors are configured to detachably couple the upper canopy section to the lower canopy section of the canopy, and wherein the upper canopy section is configured to partially overlap the lower canopy section along the load sensitive connectors; and a plurality of vents created between the detachably coupled upper canopy section and the lower canopy section of the canopy between the load sensitive connectors, wherein one or more of the load sensitive connectors are configured to detach upon impact from a wind gust that exceeds a second predefined wind speed of more than about 20 miles per hour to allow wind to flow freely through one or more of the vents created between the upper canopy section and the lower canopy section and to preclude tilting and lifting actions caused by the wind on the wind-resistant umbrella, thereby precluding dislodgment of the wind-resistant umbrella from an anchoring location.

2. The wind-resistant umbrella of claim 1, wherein the predefined size of the surface area of the detachably coupled upper canopy section is between about 45% and about 60% of the surface area of the lower canopy section.

3. The wind-resistant umbrella of claim 1, wherein the first predefined wind speed at which the flexible ribs are configured to flex is more than about 10 miles per hour.

4. The wind-resistant umbrella of claim 1, wherein the flexible ribs are configured to flex inwardly to preclude the wind from traveling under the canopy.

5. The wind-resistant umbrella of claim 1, wherein each of the load sensitive connectors comprises:

a bracket assembly configured to be attached to the lower canopy section of the canopy, the bracket assembly comprising:

a base member;

an outer bracket rigidly attached to the base member, wherein the outer bracket comprises a space defined by an inner wall of the outer bracket and an upper surface of the base member;

an inner bracket coaxially disposed on the upper surface of the base member, within the space defined by the outer bracket and the upper surface of the base member, wherein the inner bracket comprises an opening defined by an inner wall of the inner bracket; and at least two flanges extending from at least two diametrically opposite sides of the outer bracket, wherein the at least two flanges are configured to be attached to the lower canopy section of the canopy; and a bolt assembly in engageable communication with the bracket assembly, wherein the bolt assembly comprises:

a head member configured to be attached to the upper canopy section of the canopy; and an elongate member extending from a lower end of the head member, wherein the elongate member is configured to be inserted into the opening of the inner bracket of the bracket assembly for coupling the upper canopy section to the lower canopy section of the canopy, and wherein, when speed of the wind exceeds the second predefined wind speed, the elongate member of at least one of the load sensitive connectors is configured to disengage from the opening in the inner bracket of the bracket assembly of the at least one of the load sensitive connectors and generate a sound to provide an audible warning to a user that the speed of the wind is beyond a predefined safe limit.

6. The wind-resistant umbrella of claim 5, wherein the at least two flanges of the bracket assembly comprise a supplementary flange extending from another side of the outer bracket of the bracket assembly, wherein the supplementary flange is configured to be attached to the lower canopy section of the canopy.

7. The wind-resistant umbrella of claim 5, wherein the bolt assembly of the each of the load sensitive connectors further comprises a plurality of sound generating elements configured along a length of the elongate member of the bolt assembly, wherein the sound generating elements, on disengagement of the elongate member of the bolt assembly from the opening in the inner bracket of the bracket assembly, are configured to generate the sound by friction on indentations configured on the inner wall of the inner bracket of the bracket assembly.

8. The wind-resistant umbrella of claim 1, wherein the pole member comprises an upper pole section and a lower pole section, wherein the upper pole section is coaxially connected to the lower pole section using a securing assembly.

9. The wind-resistant umbrella of claim 8, further comprising an anchoring element fixed at an anchoring portion of the lower pole section of the pole member, wherein the anchoring element is configured to securely lodge the pole member into the anchoring location.

10. The wind-resistant umbrella of claim 8, further comprising a depth indicator configured at a predefined distance from a tip of the lower pole section of the pole member, wherein the depth indicator is configured to indicate a predetermined depth to insert the pole member into the anchoring location for maximum safety to preclude the dislodgment of the pole member from the anchoring location.

11. The wind-resistant umbrella of claim 1, wherein the lower canopy section of the canopy is positioned coaxial to a position of the upper canopy section of the canopy about the pole member.

12. The wind-resistant umbrella of claim 1, further comprising a highlighted pattern configured on a lower surface of the upper canopy section of the canopy, wherein, when the one or more of the load sensitive connectors detach, the highlighted pattern is revealed for displaying a visual caution to a user that speed of the wind is beyond a predefined safe limit.

13. The wind-resistant umbrella of claim 1, further comprising a highlighted flag attached to each of the one or more load sensitive connectors, on a lower surface of the upper canopy section of the canopy, wherein, when the one or more of the load sensitive connectors detach, the highlighted flag is revealed for displaying a visual caution to a user that speed of the wind is beyond a predefined safe limit.

14. The wind-resistant umbrella of claim 1, further comprising a supplementary connector disposed at a center of the upper canopy section of the canopy and fixed to the upper end of the pole member, wherein the supplementary connector is configured to generate a whistling sound on receiving the wind of speed exceeding the second predefined wind speed of more than about 20 miles per hour for providing an audible warning to a user that the speed of the wind is beyond a predefined safe limit.

15. An audible connection assembly for detachably coupling an upper canopy section to a lower canopy section of a wind-resistant umbrella and providing an audible warning to a user, the audible connection assembly comprising:

a plurality of load sensitive connectors attached at a lower peripheral edge of the upper canopy section and proximal to an upper peripheral edge of the lower canopy section of the wind-resistant umbrella for detachably coupling the upper canopy section to the lower canopy section of the wind-resistant umbrella, wherein the upper canopy section is configured to partially overlap the lower canopy section along the load sensitive connectors, each of the load sensitive connectors comprising:

a bracket assembly configured to be attached to the lower canopy section of the wind-resistant umbrella, the bracket assembly comprising:

a base member;

an outer bracket rigidly attached to the base member, wherein the outer bracket comprises a space defined by an inner wall of the outer bracket and an upper surface of the base member;

an inner bracket coaxially disposed on the upper surface of the base member, within the space defined by the outer bracket and the upper surface of the base member, wherein the inner bracket comprises an opening defined by an inner wall of the inner bracket; and at least two flanges extending from at least two diametrically opposite sides of the outer bracket, wherein the at least two flanges are configured to be attached to the lower canopy section of the wind-resistant umbrella; and a bolt assembly in engageable communication with the bracket assembly, wherein the bolt assembly comprises:

a head member configured to be attached to the upper canopy section of the wind-resistant umbrella; and an elongate member extending from a lower end of the head member, wherein the elongate member is configured to be inserted into the opening of the inner bracket of the bracket assembly for coupling the upper canopy section to the lower canopy section of the canopy, and wherein, when speed of wind impacting the wind-resistant umbrella exceeds a predefined wind speed of more than about 20 miles per hour, the elongate member of at least one of the load sensitive connectors is configured to disengage from the opening in the inner bracket of the bracket assembly of the at least one of the load sensitive connectors and generate a sound to provide an audible warning to a user that the speed of the wind is beyond a predefined safe limit.

16. The audible connection assembly of claim 15, wherein the at least two flanges of the bracket assembly of the each of the load sensitive connectors comprise a supplementary flange extending from another side of the outer bracket of the bracket assembly, wherein the supplementary flange is configured to be attached to the lower canopy section of the wind-resistant umbrella.

17. The audible connection assembly of claim 15, wherein the bolt assembly of the each of the load sensitive connectors further comprises a plurality of sound generating elements configured along a length of the elongate member of the bolt assembly, wherein the sound generating elements, on disengagement of the elongate member of the bolt assembly from the opening in the inner bracket of the bracket assembly, are configured to generate the sound by friction on indentations configured on the inner wall of the inner bracket of the bracket assembly.

18. The audible connection assembly of claim 15, wherein the predefined size of a surface area of the detachably coupled upper canopy section is between about 45% and about 60% of a surface area of the lower canopy section.

19. The audible connection assembly of claim 15, further comprising a highlighted flag attached to the at least one of the load sensitive connectors, on a lower surface of the upper canopy section of the wind-resistant umbrella, wherein, when the at least one of the load sensitive connectors detach, the highlighted flag is revealed for displaying a visual caution to the user that the speed of the wind is beyond the predefined safe limit.

20. A method for precluding dislodgment of a wind-resistant umbrella from an anchoring location and simultaneously providing one or more warnings to a user, the method comprising:

providing the wind-resistant umbrella comprising:

a pole member;

a canopy attached to an upper end of the pole member, wherein the canopy comprises an upper canopy section and a lower canopy section, and wherein a surface area of the upper canopy section is of a predefined size with respect to a surface area of the lower canopy section;

a plurality of flexible ribs extending radially from the upper end of the pole member towards a lower peripheral edge of the lower canopy section of the canopy, wherein the flexible ribs are configured to support the upper canopy section and the lower canopy section of the canopy; and a plurality of load sensitive connectors positioned on the flexible ribs and attached at a lower peripheral edge of the upper canopy section and proximal to an upper peripheral edge of the lower canopy section, wherein the upper canopy section is configured to partially overlap the lower canopy section along the load sensitive connectors;

detachably coupling the upper canopy section to the lower canopy section of the canopy of the wind-resistant umbrella using the load sensitive connectors;

upon impact from a wind gust that exceeds a first predefined wind speed, flexing the flexible ribs of the wind-resistant umbrella inwardly to preclude wind from traveling under the canopy of the wind-resistant umbrella; and upon impact from a wind gust that exceeds a second predefined wind speed, detaching one or more of the load sensitive connectors to allow wind to flow freely through one or more of a plurality of vents created between the detachably coupled upper canopy section and the lower canopy section between the load sensitive connectors, while generating a sound to provide an audible warning to the user, and to preclude tilting and lifting actions caused by the wind on the wind-resistant umbrella, thereby precluding dislodgment of the wind-resistant umbrella from the anchoring location.

21. The method of claim 20, wherein the predefined size of the surface area of the detachably coupled upper canopy section is between about 45% and about 60% of the surface area of the lower canopy section.

22. The method of claim 20, wherein the first predefined wind speed at which the flexible ribs flex inwardly is more than about 10 miles per hour, and wherein the second predefined wind speed of the wind gust causing the one or more of the load sensitive connectors to detach is more than about 20 miles per hour.

23. The method of claim 20, further comprising providing a visual caution to the user that speed of the wind is beyond a predefined safe limit using at least one of:

a highlighted pattern configured on a lower surface of the upper canopy section of the canopy, wherein, when the one or more of the load sensitive connectors detach, the highlighted pattern is revealed for displaying the visual caution to the user; and a highlighted flag attached to each of the one or more load sensitive connectors, on the lower surface of the upper canopy section of the canopy, wherein, when the one or more of the load sensitive connectors detach, the highlighted flag is revealed for displaying the visual caution to the user.

* * * * *